US010569558B2

(12) United States Patent
Nagai et al.

(10) Patent No.: US 10,569,558 B2
(45) Date of Patent: Feb. 25, 2020

(54) LIQUID EJECTION HEAD AND RECORDING APPARATUS

(71) Applicant: CANON KABUSHIKI KAISHA, Tokyo (JP)

(72) Inventors: Noriyasu Nagai, Tokyo (JP); Koichi Kubo, Yokohama (JP); Naozumi Nabeshima, Tokyo (JP); Soji Kondo, Yokohama (JP); Kazuya Yoshii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/013,298

(22) Filed: Jun. 20, 2018

(65) Prior Publication Data

US 2019/0001690 A1 Jan. 3, 2019

(30) Foreign Application Priority Data

Jun. 29, 2017 (JP) ..... 2017-127485

(51) Int. Cl.
*B41J 2/175* (2006.01)
*B41J 2/14* (2006.01)

(52) U.S. Cl.
CPC ..... *B41J 2/17563* (2013.01); *B41J 2/14145* (2013.01); *B41J 2/17523* (2013.01); *B41J 2202/12* (2013.01); *B41J 2202/14* (2013.01); *B41J 2202/20* (2013.01)

(58) Field of Classification Search
CPC ..... B41J 2/17563; B41J 2202/12
See application file for complete search history.

(56) References Cited

U.S. PATENT DOCUMENTS 7,165,835 B2 * 1/2007 Ota ..... B41J 2/17509 347/85
8,454,140 B2 6/2013 Kondo
9,346,269 B2 5/2016 Akahane et al.
9,707,760 B2 7/2017 Togashi et al.
9,962,937 B2 5/2018 Okushima et al.
10,022,979 B2 7/2018 Okushima et al.
(Continued)

FOREIGN PATENT DOCUMENTS

JP 2015-174391 A 10/2015
WO 2014/088533 A1 6/2014

OTHER PUBLICATIONS

Extended European Search Report dated Nov. 7, 2018, in European Patent Application No. 18180020.2.
(Continued)

*Primary Examiner* — Huan H Tran
(74) *Attorney, Agent, or Firm* — Venable LLP

(57) ABSTRACT

A liquid ejection head includes a liquid ejection portion configured to eject a liquid and a liquid supplying member. The liquid supplying member includes a first face, a second face that is the back face of the first face, a first connecting portion provided on the first face and fluidly connected to a main body, a second connecting portion provided on the second face and fluidly connected to the liquid ejection portion, and an interior channel communicating the first connecting portion and the second connecting portion. The interior channel includes a portion extending toward the first face and a portion extending toward the second face.

18 Claims, 22 Drawing Sheets

(56) References Cited

U.S. PATENT DOCUMENTS

| | | | | |
|---|---|---|---|---|
| 2012/0293585 | A1* | 11/2012 | Hanagami | B41J 2/175 347/47 |
| 2015/0258789 | A1* | 9/2015 | Togashi | B41J 2/14201 347/44 |
| 2017/0087867 | A1* | 3/2017 | Sato | B41J 2/17596 |
| 2017/0197409 | A1 | 7/2017 | Okushima et al. | |
| 2017/0197419 | A1 | 7/2017 | Okushima et al. | |
| 2017/0274647 | A1 | 9/2017 | Aoki et al. | |
| 2017/0282623 | A1 | 10/2017 | Togashi et al. | |
| 2018/0043688 | A1 | 2/2018 | Okushima et al. | |

OTHER PUBLICATIONS

U.S. Appl. No. 16/014,624, Genji Inada, Naozumi Nabeshima, Soji Kondo, Noriyasu Nagai, Takuya Iwano, filed Jun. 21, 2018.
U.S. Appl. No. 16/018,454, Kazuhiro Yamada, Shuzo Iwanaga, Seiichiro Karita, Shingo Okushima, Zentaro Tamenaga, Noriyasu Nagai, Tatsurou Mori, Akio Saito, Akira Yamamoto, Asuka Horie, Masao Furukawa, Takatsuna Aoki, filed Jun. 26, 2018.
U.S. Appl. No. 16/023,369, Koichi Kubo, Naozumi Nabeshima, Soji Kondo, Kazuya Yoshii, Noriyasu Nagai, filed Jun. 29, 2018.
U.S. Appl. No. 16/025,371, Soji Kondo, Naozumi Nabeshima, Koichi Kubo, Kazuya Yoshii, Noriyasu Nagai, filed Jul. 2, 2018.
U.S. Appl. No. 16/025,564, Kazuya Yoshii, Koichi Kubo, Naozumi Nabeshima, Soji Kondo, Noriyasu Nagai, filed Jul. 2, 2018.

* cited by examiner

FIG. 5A
FIG. 5B
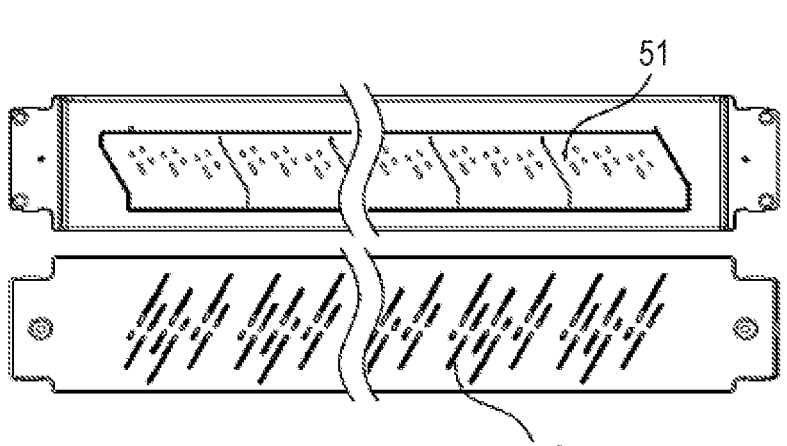
FIG. 5C
FIG. 5D
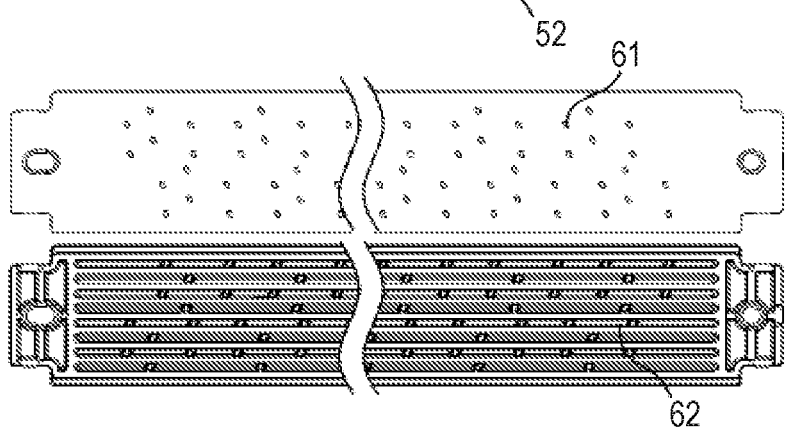
FIG. 5E
FIG. 5F
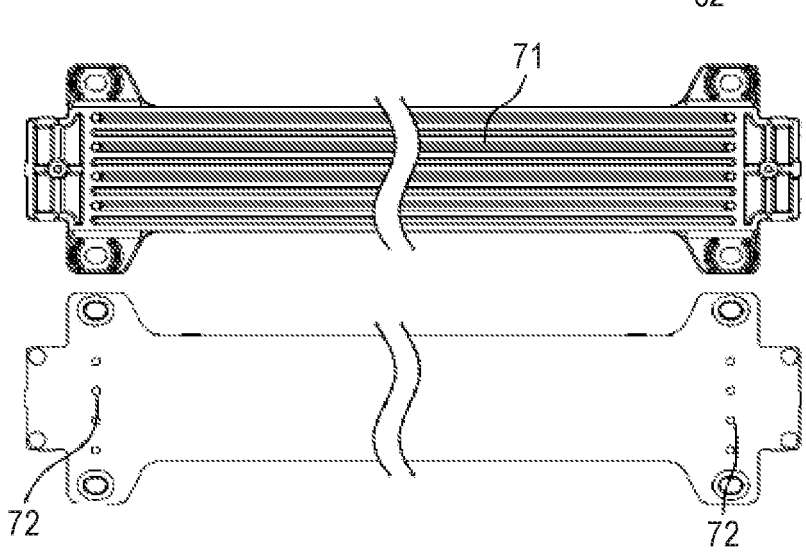

LIQUID EJECTION HEAD AND RECORDING APPARATUS

BACKGROUND OF THE INVENTION

Field of the Invention

The present invention relates to a liquid ejection head and a recording apparatus and specifically relates to the structure of a liquid ejection head that is removably attached to a recording apparatus.

Description of the Related Art

A liquid ejection head includes a liquid supplying member including an interior channel for supplying a liquid to a recording element substrate that ejects a liquid. Japanese Patent Application Laid-Open No. 2015-174391 discloses a liquid jet head including a channel structure for supplying an ink from an ink container, a channel controller for controlling the channel, and a liquid jet part. The liquid jet part includes a filter for removing dusts or bubbles contained in a liquid and a liquid jet unit for jetting a liquid. A plurality of the liquid jet units are provided and linearly arranged to form a line head.

When the liquid ejection head disclosed in Japanese Patent Application Laid-Open No. 2015-174391 is detached from the main body of a recording apparatus for replacement and the liquid ejection head is tilted or subjected to an impact such as dropping, a connecting portion to the main body may leak a liquid.

SUMMARY OF THE INVENTION

The present invention is intended to provide a liquid ejection head that is removably attached to the main body of a recording apparatus and can suppress the amount of a liquid that may leak from a connecting portion to the main body when the liquid ejection head is detached from the main body.

A liquid ejection head of the present invention is removably attached to a main body of a recording apparatus and ejects a liquid supplied from the main body. The liquid ejection head includes a liquid ejection portion configured to eject a liquid and a liquid supplying member. The liquid supplying member includes a first face, a second face that is a back face of the first face, a first connecting portion provided on the first face and fluidly connected to the main body, a second connecting portion provided on the second face and fluidly connected to the liquid ejection portion, and an interior channel communicating the first connecting portion and the second connecting portion, and supplies a liquid from the main body to the liquid ejection portion. The interior channel includes, for a liquid flow from the first connecting portion to the second connecting portion, a portion extending toward the first face and a portion extending toward the second face.

Further features of the present invention will become apparent from the following description of exemplary embodiments with reference to the attached drawings.

BRIEF DESCRIPTION OF THE DRAWINGS

FIGS. 5A, 5B, 5C, 5D, 5E and 5F are views schematically showing front faces and back faces of first to third channel members.

DESCRIPTION OF THE EMBODIMENTS

Preferred embodiments of the present invention will now be described in detail in accordance with the accompanying drawings.

The present invention will now be described with reference to embodiments. The following embodiments are intended to describe what is called a line head (page wide type liquid ejection head) having a length corresponding to the width of a recording medium, but the present invention can be applied to what is called a serial liquid ejection head that performs recording while performing scanning on a recording medium. Non-limited examples of the serial liquid ejection head include a head including one recording element substrate for ejecting a black ink and one recording element substrate for ejecting color inks. For example, a serial liquid ejection head may have the structure in which a plurality of recording element substrates are arranged while ejection ports overlap in the ejection port array direction and a short liquid ejection head shorter than the width of a recording medium is scanned on the recording medium. The liquid ejection head in the present embodiment adopts a thermal system using heat generation elements for generating bubbles to eject an ink, but the present invention is also applicable to liquid ejection heads adopting a piezoelectric system or other liquid ejection systems. The liquid ejection head of the embodiment is intended to eject an ink but may eject other liquids than inks.

(Description of Ink jet Recording Apparatus)

Figure 1:
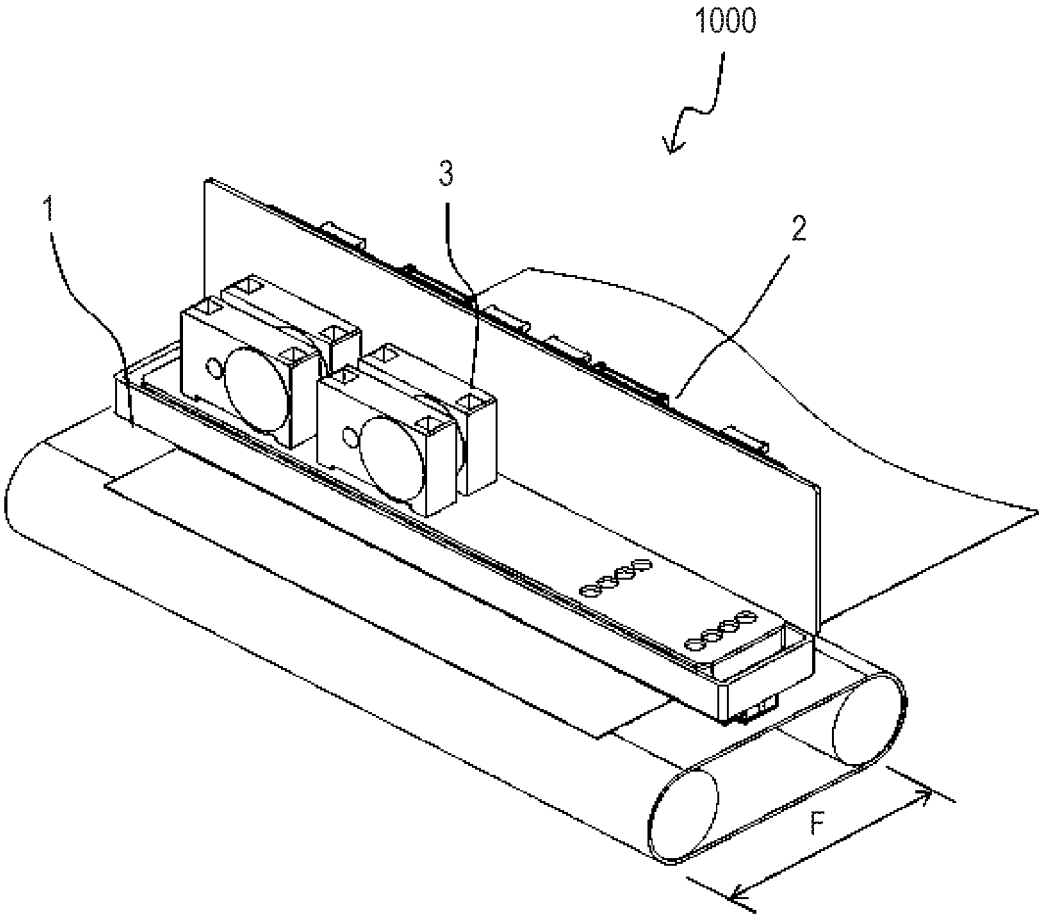
FIG. 1 is a schematic perspective view of a recording apparatus pertaining to an embodiment of the present invention.

A schematic structure of a recording apparatus of the present invention, specifically, an ink jet recording apparatus 1000 that ejects an ink for recording (hereinafter also called recording apparatus) is shown in FIG. 1. The recording apparatus 1000 is a line recording apparatus that performs continuous recording in a single pass manner while a plurality of recording media 2 are conveyed continuously or intermittently. The recording apparatus 1000 includes a conveyer 1 configured to convey a recording medium 2 and a line liquid ejection head 3 provided substantially orthogonal to the conveyance direction of the recording medium. Of the recording apparatus 1000, the portion except the liquid ejection head 3 may also be called a recording apparatus main body or a main body 1001 (see FIG. 2). The recording medium 2 is not limited to a cut paper but may be a continuous roll paper. The liquid ejection head 3 enables full color printing with cyan, magenta, yellow, and black (CMYK) inks. As described later, the liquid ejection head 3 is fluidly connected to liquid supplying means as supplying paths for supplying inks to the liquid ejection head, main tanks, and buffer tanks (see FIG. 2). The liquid ejection head 3 is electrically connected to an electric controller that transmits electric power and ejection control signals to the liquid ejection head 3. The ink pathways and electric signal pathways in the ejection head 3 will be described later.

(Description of First Circulation Pathway)

Figure 2:
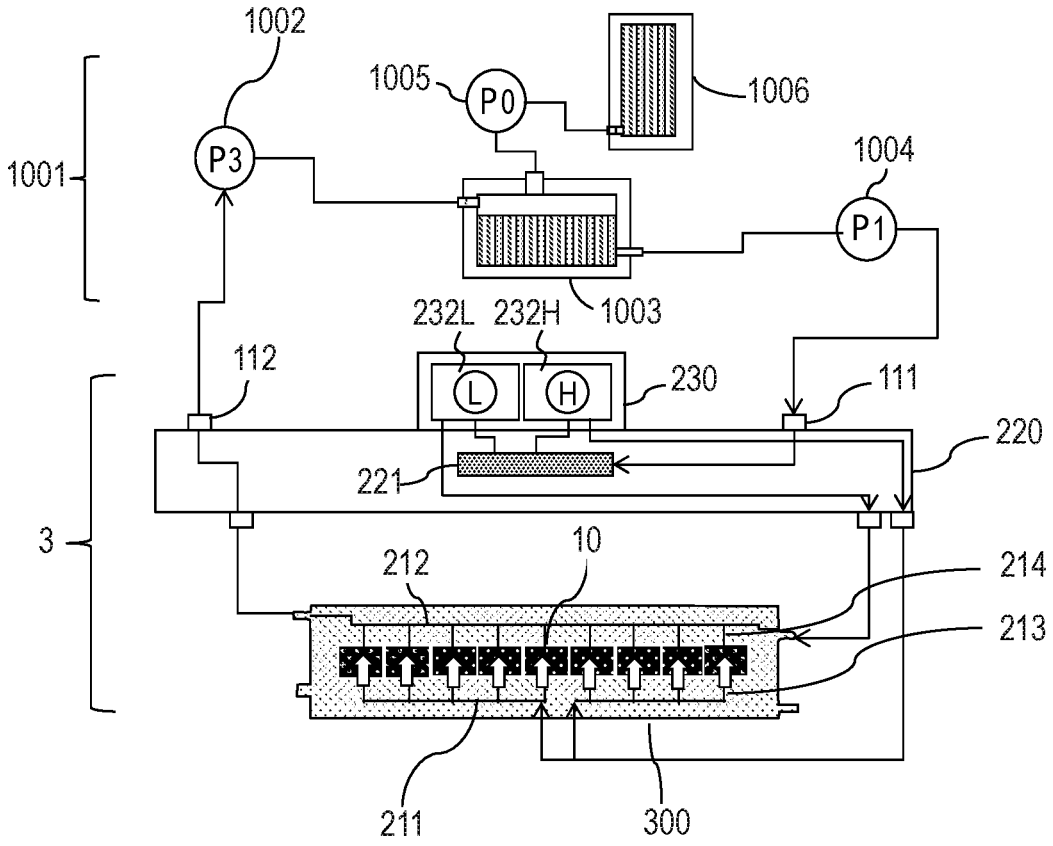
FIG. 2 is a schematic view showing an ink circulation pathway of a liquid ejection head in an embodiment of the present invention.

FIG. 2 is a schematic view showing an exemplary circulation pathway applied to the recording apparatus of the present embodiment. FIG. 2 shows only a pathway through which a single color ink of the CMYK inks passes for simple explanation, but in an actual apparatus, circulation pathways for four colors are provided in the liquid ejection head 3 and the main body 1001. A buffer tank 1003 connected to a main tank 1006 and functioning as a sub tank has an air communicating port (not shown) for communication between the inside and the outside of the tank and can discharge bubbles in an ink to the outside. The buffer tank 1003 is also connected to a supply pump 1005. When an ink is ejected (discharged) from ejection ports by a recording operation or an aspiration recovery operation and the ink is consumed in the liquid ejection head 3, the supply pump 1005 supplies a consumed amount of the ink from the main tank 1006 to the buffer tank 1003.

A first circulation pump 1002 recovers an ink from the liquid ejection head 3 through a liquid connecting portion 112 and returns the ink to the buffer tank 1003. The first circulation pump 1002 is preferably a displacement pump capable of quantitatively sending a liquid, and specific examples include a tube pump, a gear pump, a diaphragm pump, and a syringe pump. The first circulation pump may have a structure in which a typical constant flow valve or a relief valve is provided at the pump outlet to achieve a constant flow rate. When the liquid ejection head 3 is driven, the first circulation pump 1002 allows a certain amount of an ink to flow in a common recovery channel 212. The ink flow rate is preferably set at a value exceeding a certain flow rate so that the temperature differences among recording element substrates 10 in the liquid ejection head 3 would not affect image qualities. However, if an excessively high flow rate is set, pressure drop in channels in a liquid ejection unit 300 increases negative pressure differences among the recording element substrates 10, causing density unevenness on an image. Hence, the ink flow rate is preferably set in consideration of temperature differences and negative pressure differences among the recording element substrates 10.

A negative pressure regulatory unit 230 is provided between a second circulation pump 1004 and the liquid ejection unit 300. The negative pressure regulatory unit 230 maintains the pressure at the downstream side of the negative pressure regulatory unit 230 (i.e., the liquid ejection unit 300 side) within a preset constant pressure range even when the circulation flow rate fluctuates due to changes in duty at the time of recording. For the purpose, the negative pressure regulatory unit 230 includes two pressure regulatory systems (negative pressure regulatory systems) 232H, 232L that are set at different control pressures from each other. The pressure regulatory system 232H is set at a relatively high control pressure, and the pressure regulatory system 232L is set at a relatively low control pressure. In the following description, if not differentiated, the pressure regulatory system 232H and the pressure regulatory system 232L may be called a pressure regulatory system 232. The pressure regulatory system 232 may have any structure that can control the downstream pressure therefrom within a certain range around a preset pressure. As the pressure regulatory system 232, a system similar to what is called a "decompression regulator" can be adopted, for example. When a decompression regulator is used, as shown in FIG. 2, the upstream side from the negative pressure regulatory unit 230 is preferably pressurized through a liquid supplying unit 220 by the second circulation pump 1004. With such a structure, the effect of the hydraulic head pressure of the buffer tank 1003 on the liquid ejection head 3 can be suppressed, and thus the layout of the buffer tank 1003 in the recording apparatus 1000 can be more freely designed. The second circulation pump 1004 may be any circulation pump that has a pump head pressure not lower than a certain value, within the range of an ink circulation flow rate when the liquid ejection head 3 is driven. For example, a turbo pump or a displacement pump can be used, and specifically, a diaphragm pump is preferably applicable. In place of the second circulation pump 1004, a hydraulic head tank located to give a certain hydraulic head difference with respect to the negative pressure regulatory unit 230 is also applicable, for example.

The pressure regulatory systems 232H, 232L are connected through interior channels in the liquid supplying unit 220 to a common supplying pathway 211 and the common recovery channel 212, respectively, in the liquid ejection unit 300. The liquid ejection unit 300 includes the common supplying pathway 211, the common recovery channel 212, and individual supplying channels 213 and individual recovery channels 214 communicating with the respective recording element substrates. The individual supplying channels 213 and the individual recovery channels 214 communicate with the common supplying pathway 211 and the common recovery channel 212. Hence, a part of the ink supplied from the first circulation pump 1002 passes through the common supplying channel 211 and interior channels in recording element substrates 10 and flows to the common recovery channel 212 (indicated by arrows in FIG. 2). This is because the set pressure of the pressure regulatory system 232H connected to the common supplying channel 211 is higher than the set pressure of the pressure regulatory system 232L connected to the common recovery channel 212, and the first circulation pump 1002 is connected to only the common recovery channel 212.

As described above, in the liquid ejection unit 300, an ink flow is generated through the common recovery channel 212, and the ink flow is generated from the common supplying channel 211 through the respective recording element substrates 10 to the common recovery channel 212. Hence, heat generated in each recording element substrate 10 is exhausted to the outside of the recording element substrate 10 by the ink flow flowing from the common supplying channel 211 to the common recovery channel 212. During recording by the liquid ejection head 3, an ink also flows in pressure chambers that do not eject the ink, and thus an increase in viscosity of the ink in the pressure chambers can be suppressed. If an ink viscosity increases, the ink causing viscosity increase is discharged by an ink flow to the common recovery channel 212. In a similar manner, foreign substances in an ink are also discharged by an ink flow to the common recovery channel 212. Hence, the liquid ejection head 3 of the embodiment enables high quality image recording at high speed.

(Description of Structure of Liquid Ejection Head)

Figure 3A:
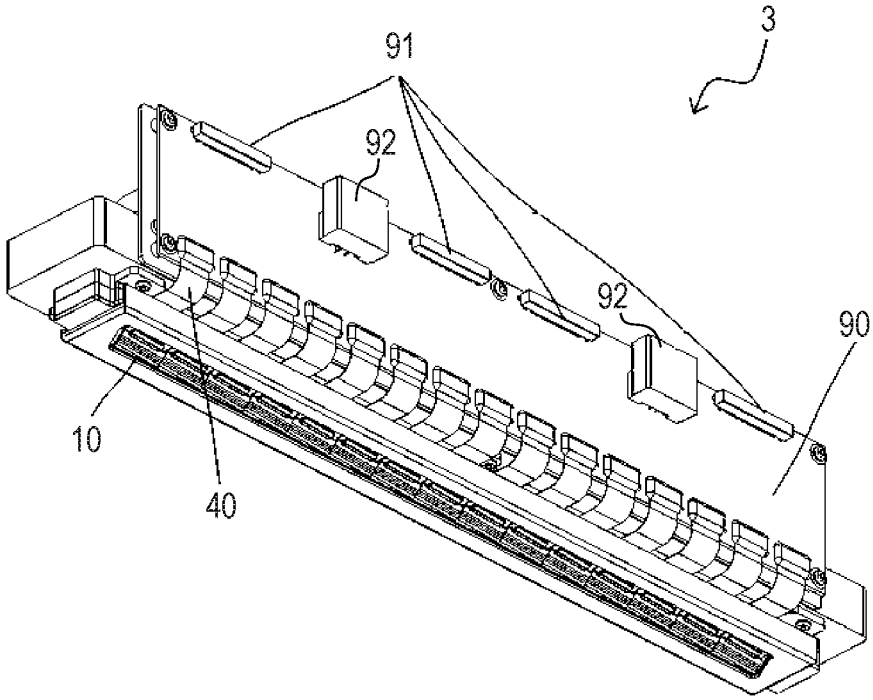
FIGS. 3A and 3B are schematic perspective views of the liquid ejection head shown in FIG. 2.
Figure 3B:
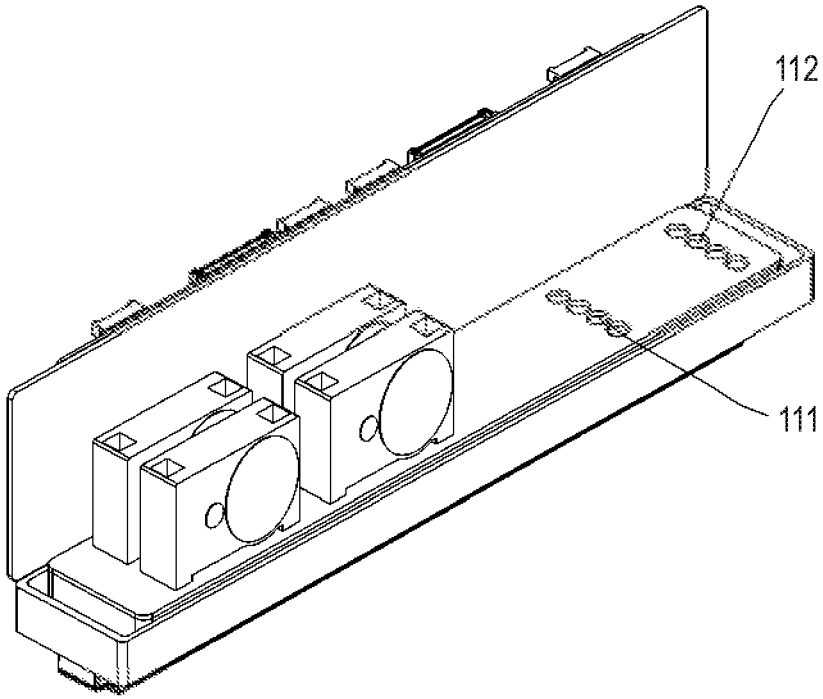

The structure of the liquid ejection head 3 will be described. FIGS. 3A and 3B are perspective views of the liquid ejection head 3 pertaining to the present embodiment. FIG. 3A is a perspective view of the liquid ejection head 3 viewed from the recording element side, and FIG. 3B is a perspective view of the liquid ejection head 3 viewed from the main body 1001 side. The liquid ejection head 3 is removably attached to the main body 1001 such that ejection ports face downward. The liquid ejection head 3 is a line liquid ejection head 3 in which 15 recording element substrates 10 are linearly arranged (inline arrangement). Each recording element substrate 10 can eject CMYK four color inks. As shown in FIG. 3A, the liquid ejection head 3 includes a plurality of recording element substrates 10, an electric wiring board 90, and signal input terminals 91 and power supply terminals 92 installed on the electric wiring board 90. The respective recording element substrates 10 are electrically connected through flexible wiring boards 40 to the signal input terminals 91 and the power supply terminals 92. The signal input terminals 91 and the power supply terminals 92 are electrically connected to a controller of the main body 1001 and supply ejection driving signals and electric power required for ejection, respectively, to the recording element substrates 10. Wirings are aggregated by electric circuits in the electric wiring board 90, and thus the numbers of the signal input terminals 91 and the power supply terminals 92 are smaller than the number of the recording element substrates 10. This structure reduces the number of electrical connecting portions that are required to be attached or detached when the liquid ejection head 3 is attached to or detached from the main body 1001. Liquid connecting portions 111, 112 provided on one side of the liquid ejection head 3 as shown in FIG. 3B are connected to an ink supply system of the main body 1001. With this structure, CMYK four color inks are supplied from the ink supply system of the main body 1001 to the liquid ejection head 3, and the inks passed through the liquid ejection head 3 are recovered to the ink supply system of the main body 1001. In other words, each ink can circulate between the ink supply system of the main body 1001 and the liquid ejection head 3 through the liquid connecting portions 111, 112.

Figure 4:
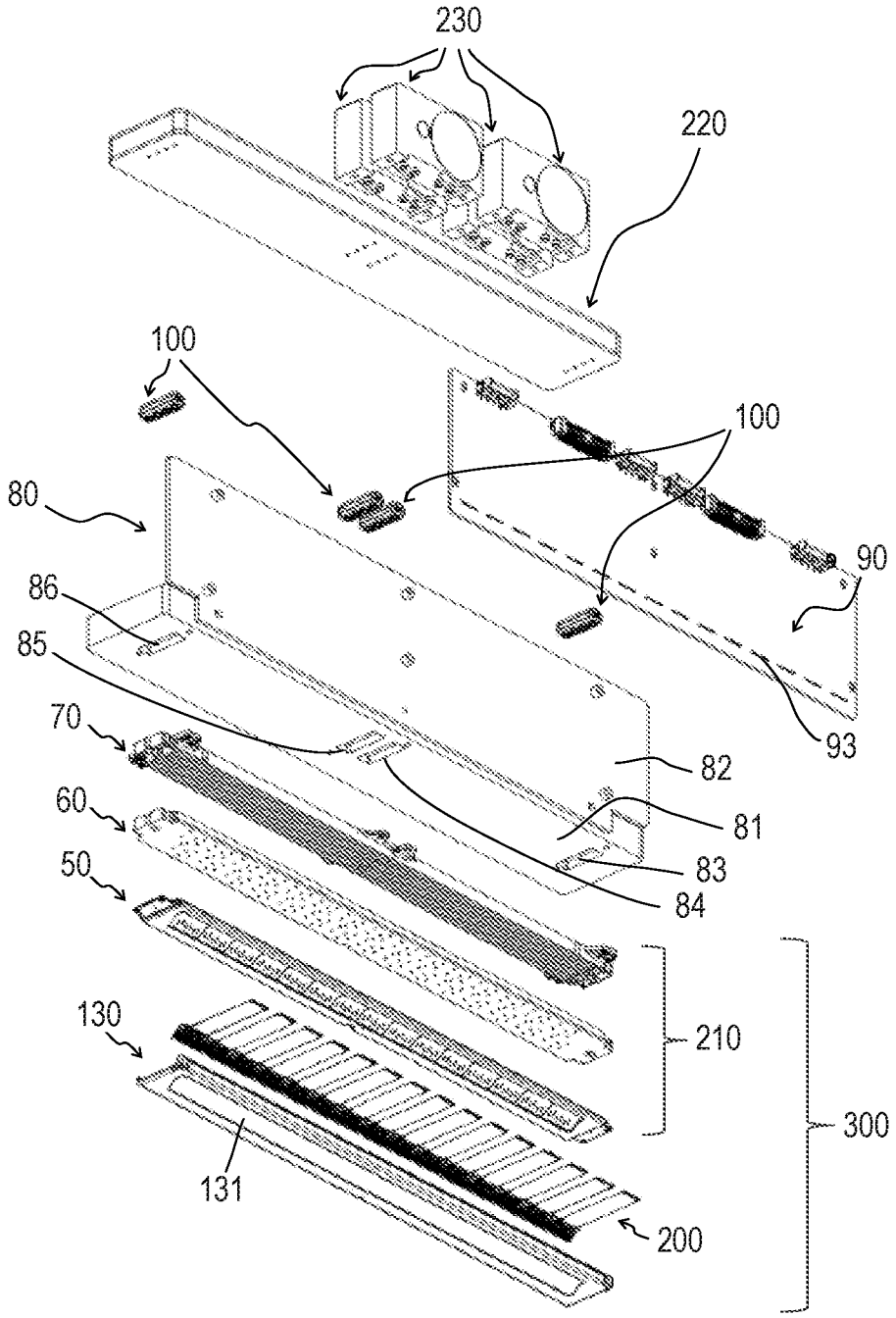
FIG. 4 is an exploded perspective view of the liquid ejection head shown in FIGS. 3A and 3B.

FIG. 4 is an exploded perspective view of components or units included in the liquid ejection head 3. To a casing 80, a liquid ejection unit 300, a liquid supplying unit 220, and an electric wiring board 90 are attached. On the liquid supplying unit 220, liquid connecting portions 111, 112 (see FIG. 3B) are provided. In the liquid supplying unit 220, a filter 221 (FIG. 2) communicating with the liquid connecting portion 111 and for removing foreign substances in an ink supplied is provided for each color. The ink passing through the filter 221 is supplied to a negative pressure regulatory unit 230 corresponding to the ink and provided on the supplying unit 220. The liquid connecting portions 111, 112 may be provided on the liquid ejection unit 300 side, but are preferably provided to face the main body 1001 so that the openings face upward in the vertical direction in order to suppress ink leakage when the liquid ejection head 3 is detached.

The casing 80 is composed of a liquid ejection unit supporting portion 81 and an electric wiring board supporting portion 82. The casing 80 supports the liquid ejection unit 300 and the electric wiring board 90 and ensures the rigidity of the liquid ejection head 3. The electric wiring board supporting portion 82 is fixed to the liquid ejection unit supporting portion 81 by screwing and supports the electric wiring board 90. The liquid ejection unit supporting portion 81 has openings 83, 84, 85, 86 into which joint rubbers 100 are inserted. Inks supplied from the liquid supplying unit 220 are introduced through the joint rubbers 100 into a third channel member 70 included in the liquid ejection unit 300.

The liquid ejection unit 300 is included in a liquid ejection portion of the liquid ejection head 3. The liquid ejection unit 300 includes a channel member 210 and a plurality of ejection modules 200. To the face of the liquid ejection unit 300 facing a recording medium, a cover member 130 is attached. The cover member 130 is, as shown in FIG. 4, a member having a frame-shaped surface with a long opening 131. From the opening 131, recording element substrates 10 and sealing members 110 (FIG. 8A) included in the ejection module 200 are exposed. The frame surrounding the opening 131 is in contact with a cap member for capping the liquid ejection head 3 during recording standby. Hence, an adhesive, a sealing member, a filler, or the like is preferably applied to the periphery of the opening 131 to fill unevenness or gaps on the ejection port face of the liquid ejection unit 300, thereby forming a closed space when the head is capped.

Next, the structure of the channel member 210 included in the liquid ejection unit 300 will be described. As shown in FIG. 4, the channel member 210 is formed by stacking a first channel member 50, a second channel member 60, and a third channel member 70. The channel member 210 distributes an ink supplied from the liquid supplying unit 220 to each ejection module 200 and returns the ink refluxed from the ejection module 200 to the liquid supplying unit 220. The channel member 210 is fixed to the liquid ejection unit supporting portion 81 by screwing.

FIGS. 5A to 5F are views showing front faces and back faces of the first to third channel members 50, 60, 70. FIG. 5A shows a face of the first channel member 50, and on the face, the ejection modules 200 are installed. FIG. 5F shows a face of the third channel member 70, and the face is in contact with the liquid ejection unit supporting portion 81.

The face of the first channel member 50 shown in FIG. 5B is joined with the face of the second channel member 60 shown in FIG. 5C. The face of the second channel member 60 shown in FIG. 5D is joined with the face of the third channel member 70 shown in FIG. 5E. Common channel grooves 62 of the second channel member 60 and common channel grooves 71 of the third channel member 70 define eight common channels extending in the longitudinal direction, or common supplying channels 211 and common recovery channels 212 for the respective color inks (see FIG. 6). Communicating ports 72 of the third channel member 70 communicate with the corresponding ports of the joint rubbers 100 and are fluidly connected to the liquid supplying unit 220. The bottom face of the common channel grooves 62 of the second channel member 60 has a plurality of communicating ports 61, and each port communicates with one end of a corresponding individual channel groove 52 of the first channel member 50. The other end of each individual channel groove 52 of the first channel member 50 has a communicating port 51, and through the communicating ports 51, the first channel member 50 fluidly communicates with a plurality of ejection modules 200. The individual channel grooves 52 can aggregate ink channels around the center in the width direction of the first channel member 50.

The first to third channel members 50, 60, 70 are preferably made from a material having corrosion resistance against inks and having a low coefficient of linear expansion. As the material, a composite material (resin material) containing a base material and an inorganic filler such as silica microparticles and fibers can be preferably used. Examples of the base material include alumina, a liquid crystal polymer (LCP), polyphenylsulfide (PPS), polysulfone (PSF), and a modified polyphenylene ether (PPE).

Figure 6:
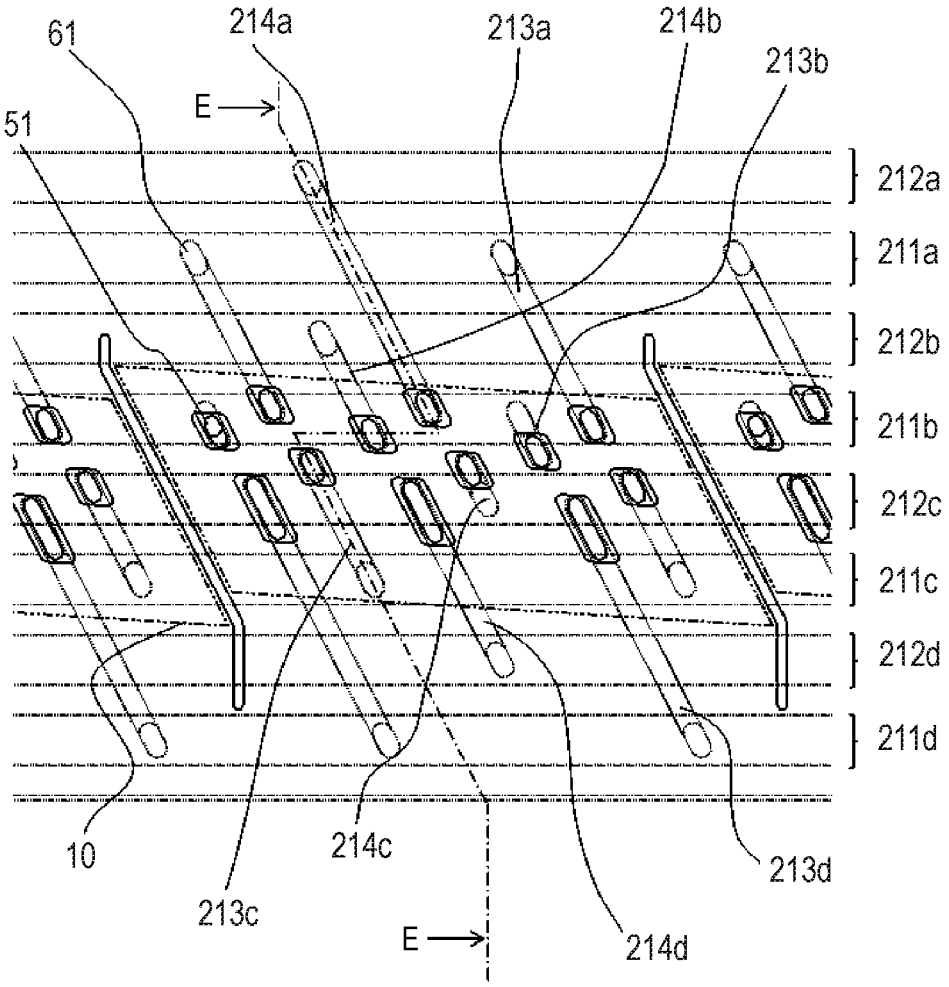
FIG. 6 is a transparent view showing the channel connecting relation between the first to third channel members and ejection modules.

With reference to FIG. 6, the connecting relation of channels in the channel member 210 will next be described. FIG. 6 is a partially enlarged transparent view of channels in the channel member 210 formed by joining the first to third channel members 50, 60, 70, viewed from the face of the first channel member 50 on which the ejection module 200 is installed. In the channel member 210, common supplying channels 211 (211*a*, 211*b*, 211*c*, 211*d*) and common recovery channels 212 (212*a*, 212*b*, 212*c*, 212*d*) extending in the longitudinal direction of the liquid ejection head 3 are formed for the respective colors. The common supplying channel 211 for each color is connected to a plurality of individual supplying channels 213 (213*a*, 213*b*, 213*c*, 213*d*) defined by individual channel grooves 52 through communicating ports 61. The common recovery channel 212 for each color is connected to a plurality of individual recovery channels 214 (214*a*, 214*b*, 214*c*, 214*d*) defined by individual channel grooves 52 through communicating ports 61. With such a channel structure, an ink can be supplied from a corresponding common supplying channel 211 through the individual supplying channels 213 to the recording element substrates 10 located at the center in the width direction of the channel member. An ink can also be recovered from the recording element substrates 10 through the individual recovery channels 214 to a corresponding common recovery channel 212.

Figure 7:
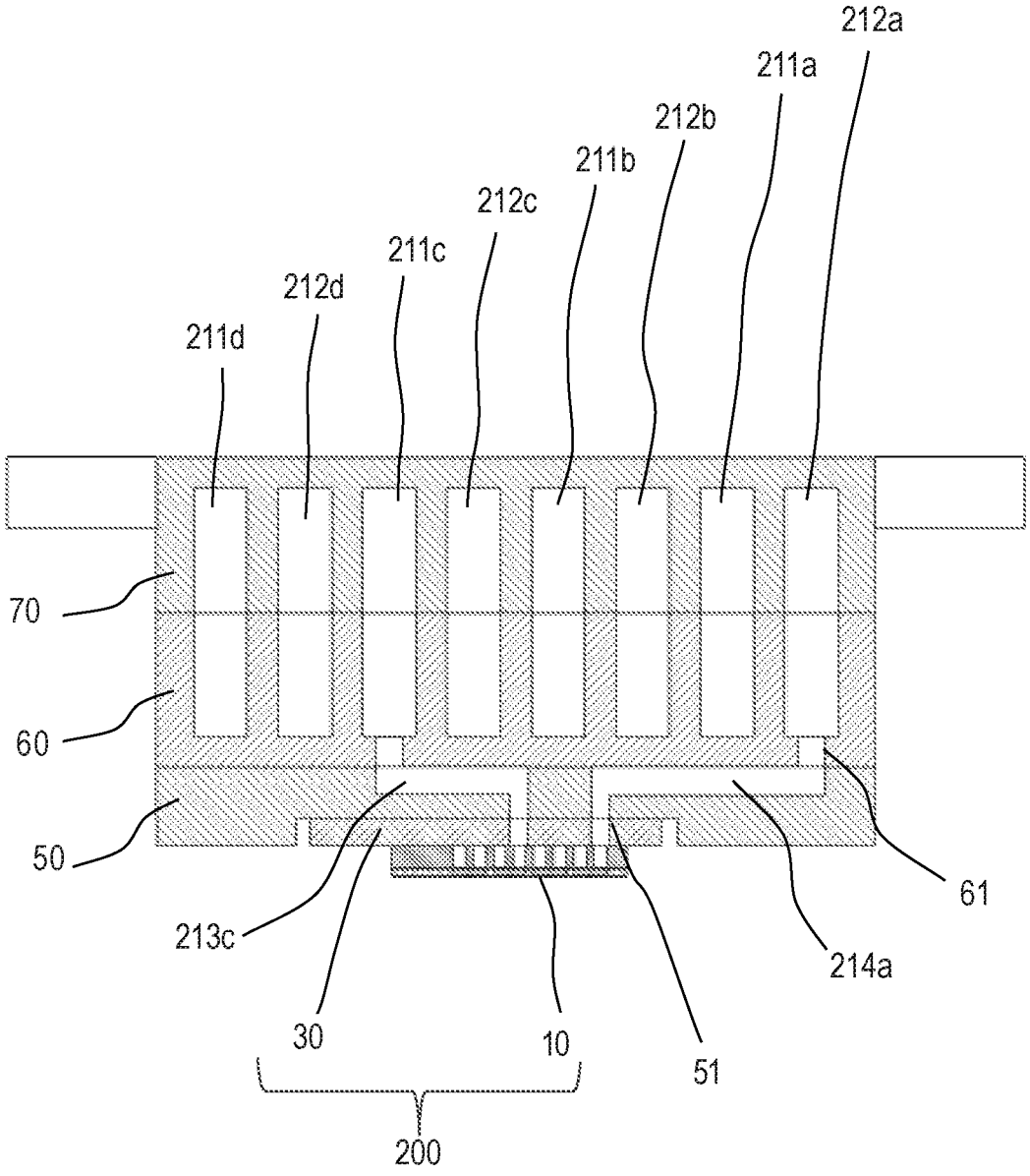
FIG. 7 is a cross-sectional view taken along the line E-E in FIG. 6.

FIG. 7 is a cross-sectional view taken along the line E-E in FIG. 6. An individual supplying channel 213*c* and an individual recovery channel 214*a* communicate with an ejection module 200 through communicating ports 51. In another cross-section, another individual supplying channel 213 and another individual recovery channel 214 communicate with the ejection module 200 as shown in FIG. 6. Each ejection module 200 includes a supporting member 30 and a recording element substrate 10. In the supporting member 30 and the recording element substrate 10, channels for supplying inks from the first channel member 50 to a recording element 15 of the recording element substrate 10 and channels for recovering (refluxing) a part or all of the inks supplied to the recording element 15 to the first channel member 50 are formed.

(Description of Ejection Module)

Figure 8A:
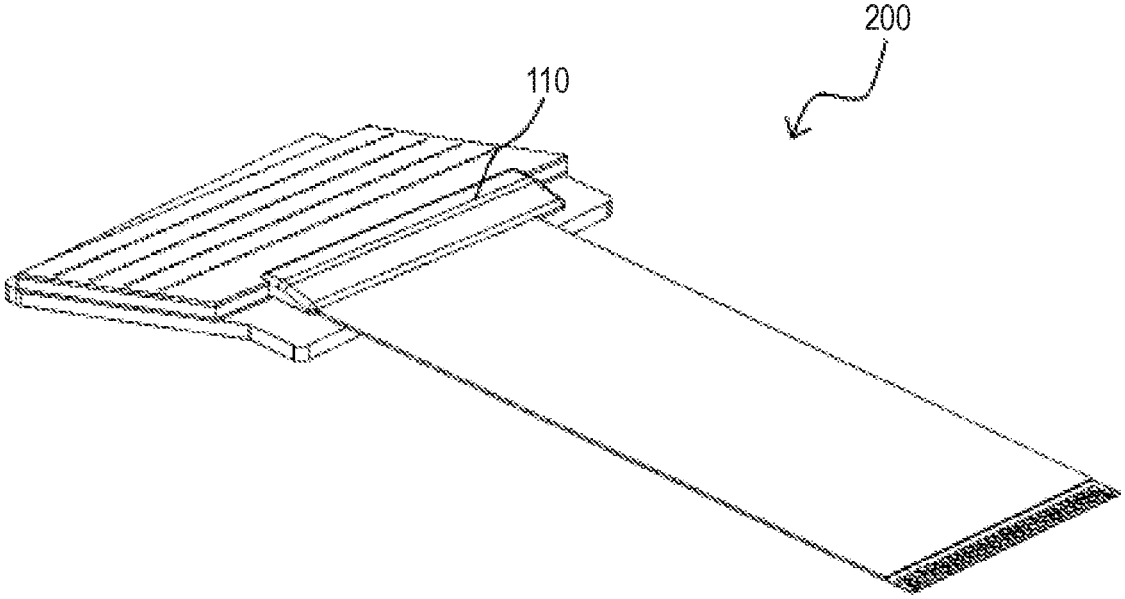
FIGS. 8A and 8B are an overall perspective view and an exploded perspective view of the ejection module.
Figure 8B:
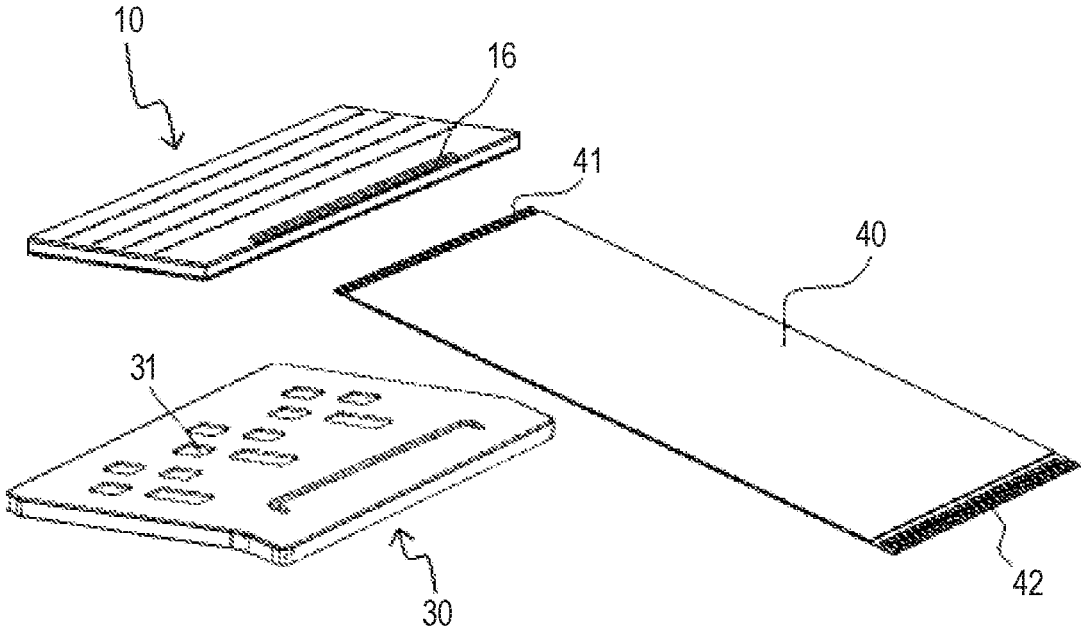

FIG. 8A is a perspective view of one ejection module 200, and FIG. 8B is an exploded view thereof. An ejection module 200 can be produced by the following procedure. First, a recording element substrate 10 and a flexible wiring board 40 are bonded to a supporting member 30 in which liquid communicating ports 31 are previously formed. Next, a terminal 16 on the recording element substrate 10 is electrically connected to a terminal 41 on the flexible wiring board 40 by wire bonding. The electrically connecting portion formed by wire bonding is then covered with a sealing member 110 to be sealed. A terminal 42 of the flexible wiring board 40 located opposite to the recording element substrate 10 is electrically connected to a connecting terminal 93 of the electric wiring board 90 (see FIG. 3A). The supporting member 30 is a supporter for supporting the recording element substrate 10 and is also a channel member for fluid communication between the recording element substrate 10 and the channel member 210. Hence, the supporting member 30 is preferably a member having high flatness and capable of being joined with the recording element substrate 10 with sufficiently high reliability, and is preferably formed from alumina or a resin material, for example.

(Description of Structure of Recording Element Substrate)

Figure 9A:
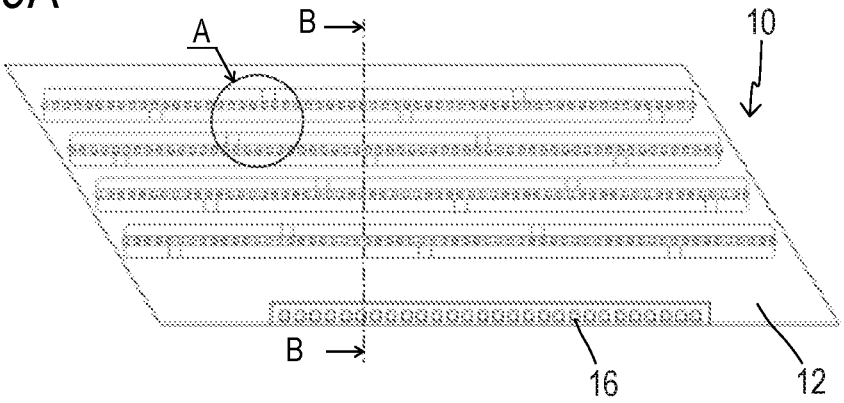
FIGS. 9A, 9B and 9C are schematic views of a recording element substrate.
Figure 9B:
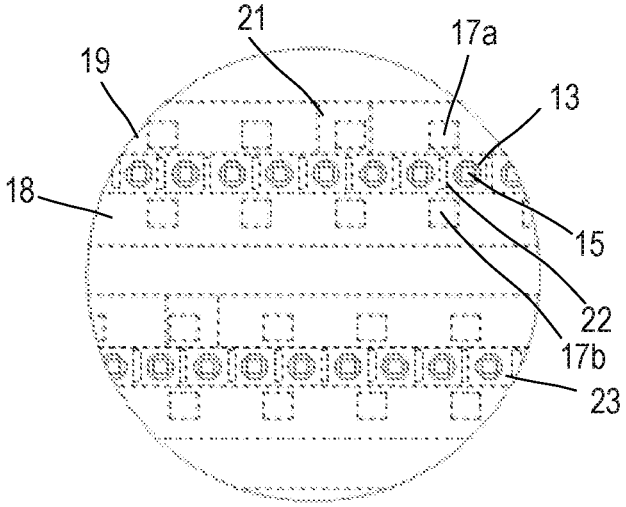
Figure 9C:
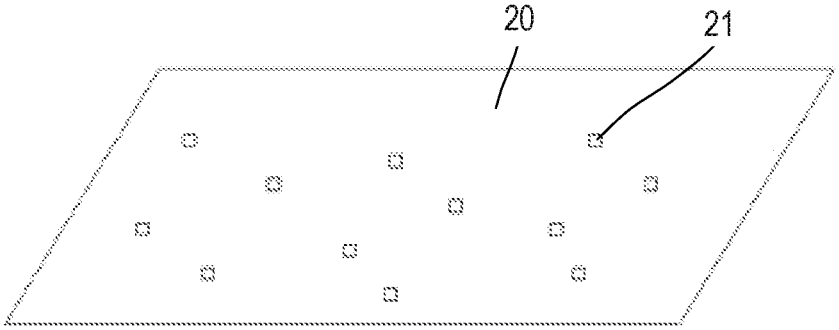

FIG. 9A is a plan view of a face of the recording element substrate 10 on which ejection ports 13 are formed, FIG. 9B is an enlarged view of the region A in FIG. 9A, and FIG. 9C is a plan view of the back face of the face shown in FIG. 9A. As shown in FIG. 9A, on an ejection opening forming member 12 of the recording element substrate 10, four ejection port arrays corresponding to the respective color inks are formed. In the following description, the direction in which a plurality of ejection ports 13 are arranged is called "ejection port array direction". As shown in FIG. 9B, at a position corresponding to each ejection port 13, a recording element 15 as a heat generation element for bubbling an ink by thermal energy is provided. Pressure chambers 23 each having the recording element 15 therein are divided by partition walls 22. Each recording element 15 is electrically connected to a terminal 16 through an electric wiring (not shown) provided in the recording element substrate 10. To the recording element 15, a pulse signal is input from a control circuit of the main body 1001 through the electric wiring board 90 (FIG. 4) and the flexible wiring board 40 (FIG. 8B). In response to the pulse signal, the recording element 15 generates heat to boil an ink. By a bubbling force by boiling, an ink is ejected from the ejection port 13. As shown in FIG. 9B, along each ejection port array, a liquid supplying path 18 extends on one side, and a liquid recovery path 19 extends on the other side. The liquid supplying path 18 and the liquid recovery path 19 extend in the recording element substrate 10 in the ejection port array direction and communicate with the ejection ports 13 through supplying ports 17*a* and recovery ports 17*b*, respectively.

Figure 10:
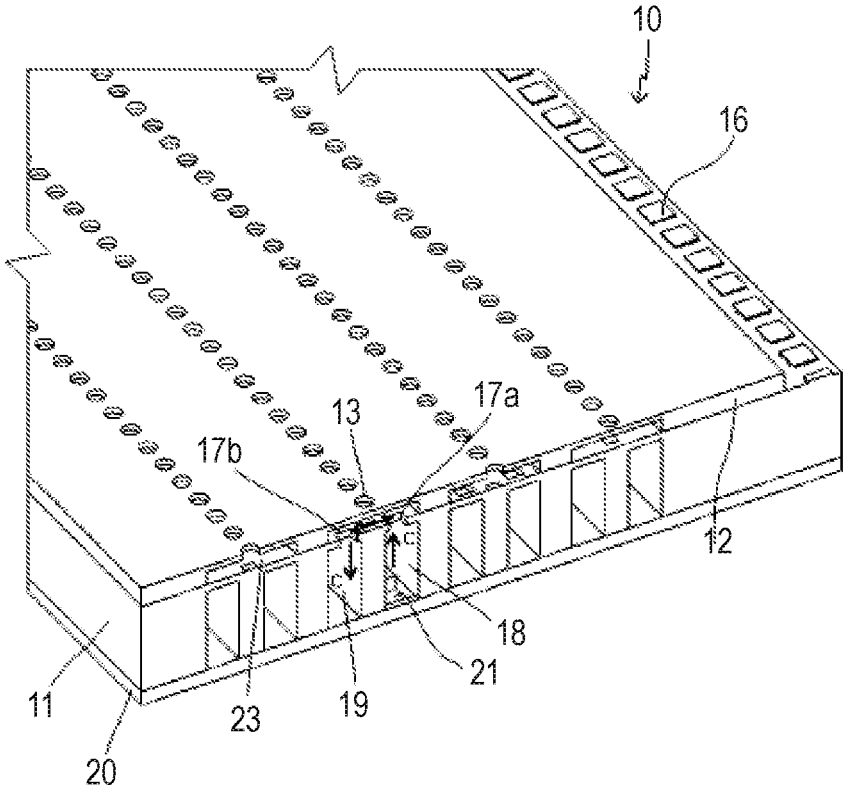
FIG. 10 is a cross-sectional view taken along the line B-B in FIG. 9A.

As shown in FIG. 9C and FIG. 10, on the face of the recording element substrate 10 opposite to the face on which the ejection ports 13 are formed, a sheet-shaped covering member 20 is stacked. The covering member 20 has a plurality of openings 21 communicating with the liquid supplying paths 18 and the liquid recovery paths 19. In the present embodiment, two openings 21 are formed for one liquid supplying path 18 and one opening 21 is formed for one liquid recovery path 19 in the covering member 20. As shown in FIG. 9B, the openings 21 of the covering member 20 communicate with a plurality of communicating ports 51 shown in FIG. 5A. With such a structure, the pitch of the channels is converted by the openings 21 of the covering member. As shown in FIG. 10, the covering member 20 functions as a cover that partially defines the walls of the liquid supplying paths 18 and the liquid recovery paths 19 formed in a substrate 11 of the recording element substrate 10. The covering member 20 preferably has sufficient corrosion resistance against inks, and in order to prevent color mixing, high precision is required for the opening shape and the opening position of the openings 21. Hence, the covering member 20 is preferably formed from a photosensitive resin material or a silicon plate, and the openings 21 are preferably formed by photolithography process. The covering member 20 is preferably thin in consideration of pressure loss and is preferably formed from a film member.

Next, the flow of an ink in the recording element substrate 10 will be described. FIG. 10 is a perspective view showing a cross-section of the recording element substrate 10 and the covering member 20 on the face B-B in FIG. 9A. The recording element substrate 10 is formed by stacking a substrate 11 made from silicon and an ejection opening forming member 12 made from a photosensitive resin. The covering member 20 is joined to the back face of the substrate 11. On the other face of the substrate 11, recording elements 15 are provided (FIG. 9B), and on the back-face side thereof, grooves defining liquid supplying paths 18 and liquid recovery paths 19 extending along ejection port arrays are formed. The liquid supplying paths 18 and the liquid recovery paths 19 defined by the substrate 11 and the covering member 20 are connected to the common supplying channels 211 and the common recovery channels 212, respectively, in the channel member 210, and differential pressures are generated between the liquid supplying paths 18 and the liquid recovery paths 19. In an ejection port 13 not ejecting an ink while the liquid ejection head 3 is activated, the differential pressure causes an ink in a liquid supplying path 18 provided in the substrate 11 to flow, as shown by the arrows C, through a supplying port 17*a*, a pressure chamber 23, and a recovery port 17*b* to a liquid recovery path 19. By this flow, an ink causing viscosity increase by evaporation from an ejection port 13, bubbles, foreign substances, or the like in an ejection port 13 or a pressure chamber 23 not ejecting an ink can be recovered to a liquid recovery path 19. In addition, the ink flow can suppress the ink viscosity increase in ejection ports 13 or pressure chambers 23. The ink recovered to the liquid recovery path 19 passes through openings 21 of the covering member 20, liquid communicating ports 31 of the supporting member 30 (see FIG. 8B), and communicating ports 51, individual recovery channels 214, and a common recovery channel 212 in the channel member 210 and is finally recovered to the ink supply system of the main body 1001.

In other words, an ink supplied from the main body 1001 to the liquid ejection head 3 flows to be supplied and recovered in the following sequence. An ink first flows from a liquid connecting portion 111 of the liquid supplying unit 220 to the liquid ejection head 3 and is supplied through a negative pressure regulatory unit 230 to a joint rubber 100. The ink flows through the joint rubber 100, a communicating port 72 and a common channel groove 71 provided in the third channel member 70, a common channel groove 62 and communicating ports 61 provided in the second channel member 60, and individual channel grooves 52 and communicating ports 51 provided in the first channel member 50, in this order. The ink is then supplied through liquid communicating ports 31 provided in the supporting member 30, openings 21 provided in the covering member 20, and a liquid supplying path 18 and supplying ports 17*a* provided in the substrate 11 in sequence to pressure chambers 23. Of the ink supplied to the pressure chambers 23, an ink not ejected from ejection ports 13 flows through recovery ports 17*b* and a liquid recovery path 19 provided in the substrate 11, openings 21 provided in the covering member 20, and liquid communicating ports 31 provided in the supporting member 30 in sequence. The ink then flows through communicating ports 51 and individual channel grooves 52 provided in the first channel member 50, communicating ports 61 and a common channel groove 62 provided in the second channel member 60, a common channel groove 71 and a communicating port 72 provided in the third channel member 70, and a joint rubber 100 in sequence. Finally, the ink is discharged from a liquid connecting portion 112 provided in the liquid supplying unit to the outside of the liquid ejection head 3.

(Description of Positional Relation Between Recording Element Substrates)

Figure 11:
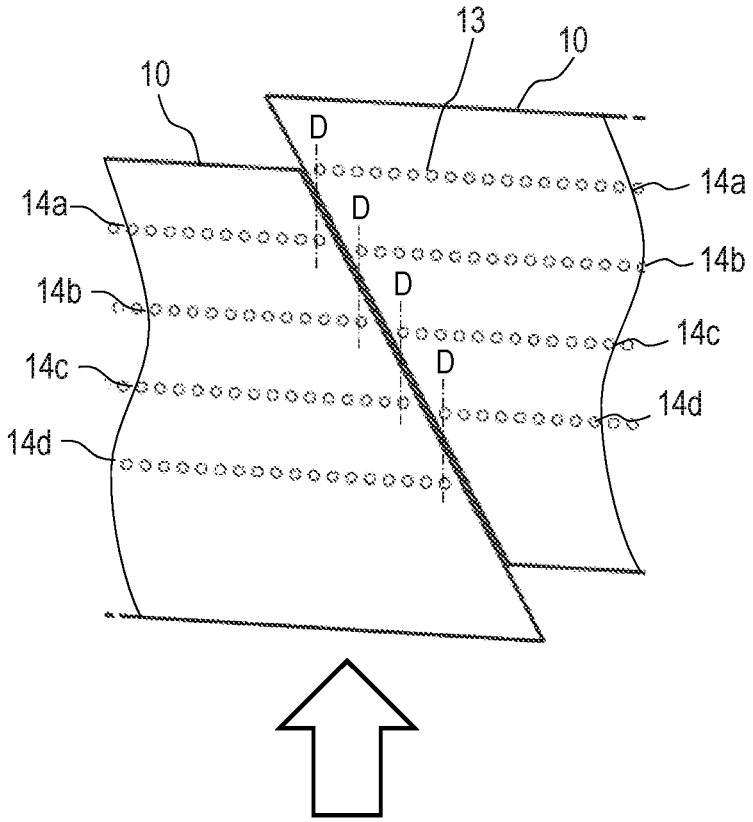
FIG. 11 is a plan view showing the adjacent region between two recording element substrates.

FIG. 11 is a partially enlarged plan view of the adjacent region of recording element substrates in adjacent two ejection modules 200. As shown in FIGS. 9A and 9C, substantially parallelogram recording element substrates are used in the present embodiment. As shown in FIG. 11, ejection port arrays 14*a* to 14*d* in which ejection ports 13 of each recording element substrate 10 are arranged are provided to have a certain angle to a direction orthogonal to the conveyance direction of a recording medium. With the arrangement, in an adjacent region of two recording element substrates 10, at least one ejection port of an ejection port array on one recording element substrate 10 overlaps with at least one ejection port of the corresponding ejection port array on the other recording element substrate 10 in the conveyance direction of a recording medium. In FIG. 11, two ejection ports on a line D overlap with each other. With such an arrangement, if a recording element substrate 10 is displaced from a predetermined position to some extent, driving control of overlapping ejection ports can make black lines or white spots on a recorded image less noticeable. When a plurality of recording element substrates 10 are not arranged in a staggered manner but are linearly arranged (inline arrangement), such an arrangement as in FIG. 11 can reduce the length of the liquid ejection head 3 in the conveyance direction of a recording medium and can suppress the formation of black lines or white spots in the adjacent region of recording element substrates 10. In the present embodiment, the principal plane of the recording element substrate is a parallelogram, but the present invention is not limited thereto. For example, a recording element substrate having a rectangular shape, a trapezoidal shape, or another shape can be used.

(Detailed Description of Liquid Supplying Member)

The liquid supplying unit 220 includes a liquid supplying member 2220, a filter 221, and a negative pressure regulatory unit 230. The filter 221 removes dusts or bubbles contained in the ink flowing through the liquid supplying member 2220. The negative pressure regulatory unit 230 controls the pressure of the ink to be ejected in order to improve image quality of printed products. A conventional liquid supplying unit has a structure in which an ink vertically flows from the top to the bottom in one direction. If a liquid supplying unit is structured on the basis of such a concept, a channel member having a liquid connecting portion 111 above a negative pressure regulatory unit 230 has a liquid connecting portion 112 below the negative pressure regulatory unit 230, and another channel member for supplying an ink to a recording element substrate 10 is required. In addition, filters 221 are required to be provided in these two channel members. This structure increases the number of parts in the liquid supplying unit. In such a liquid supplying unit, the channel from the liquid connecting portion 111 to the negative pressure regulatory unit 230 vertically extends from the top to the bottom in one direction. Hence, when a liquid ejection head 3 is removed from a recording apparatus 1000, an ink not completely removed by aspiration but left in a channel in the liquid ejection head 3 may leak from the liquid connecting portion 111 by tilt of the liquid ejection head 3 or an impact such as dropping.

In order to solve these problems, in the present embodiment, needed channel members are aggregated before and behind the negative pressure regulatory unit 230 to suppress the increase in the number of parts in the liquid supplying unit. In addition, the vertical direction of the interior channel from the liquid connecting portion 111 to the recording element substrate 10 is changed at a midway point in the present embodiment. With this structure, bubbles are left at a point where the direction of the interior channel is changed, and the bubbles separate an ink. Hence, when the liquid ejection head 3 is removed from a recording apparatus 1000, an ink flow is interrupted by bubbles, and even when the liquid ejection head 3 is tilted or is subjected to an impact such as dropping, the amount of an ink leaking from the liquid connecting portion 111 is suppressed. The structure of the liquid supplying unit 220 will next be described in detail.

Figure 12A:
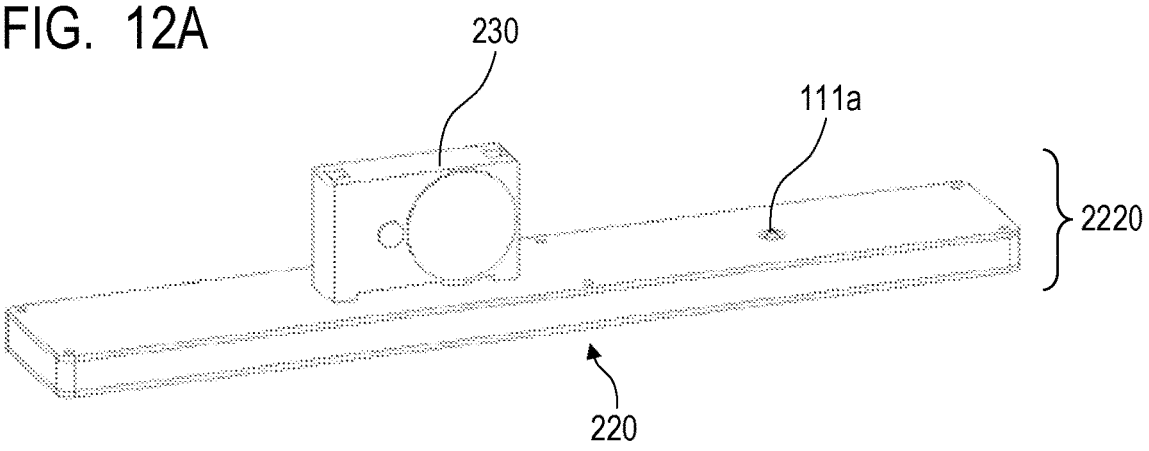
FIGS. 12A, 12B and 12C are schematic views of a liquid supplying unit pertaining to an embodiment.
Figure 12B:
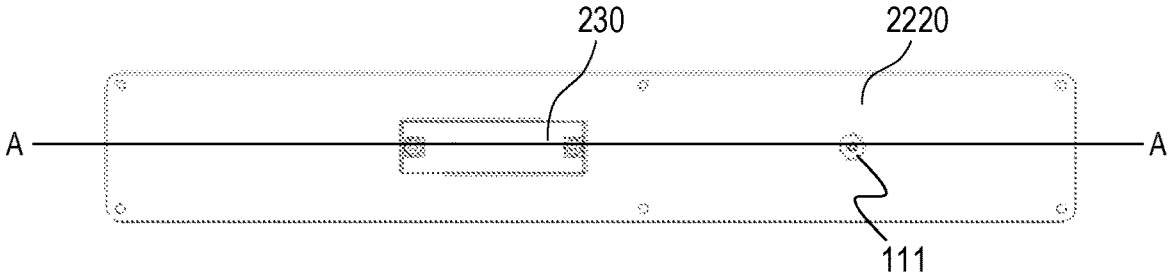
Figure 12C:
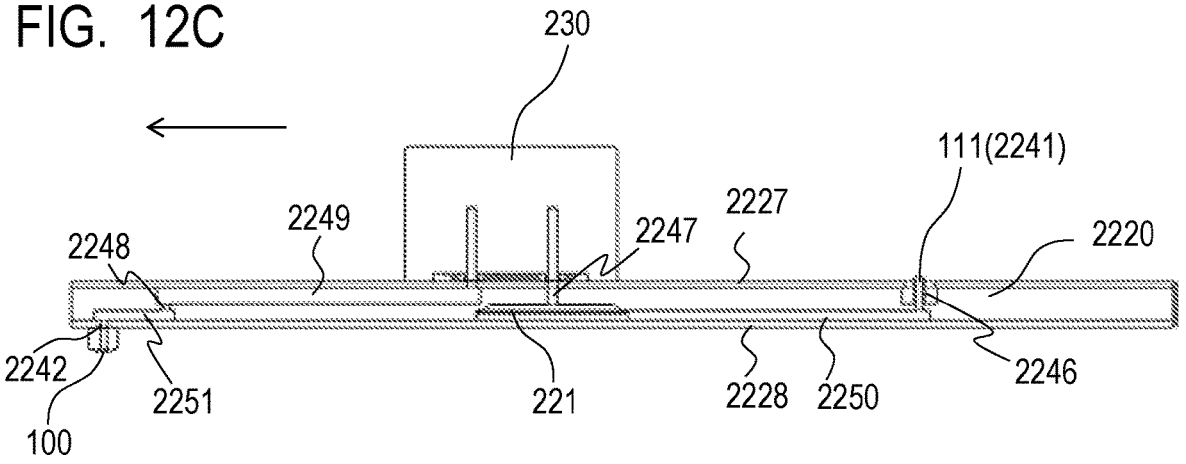
Figure 13A:
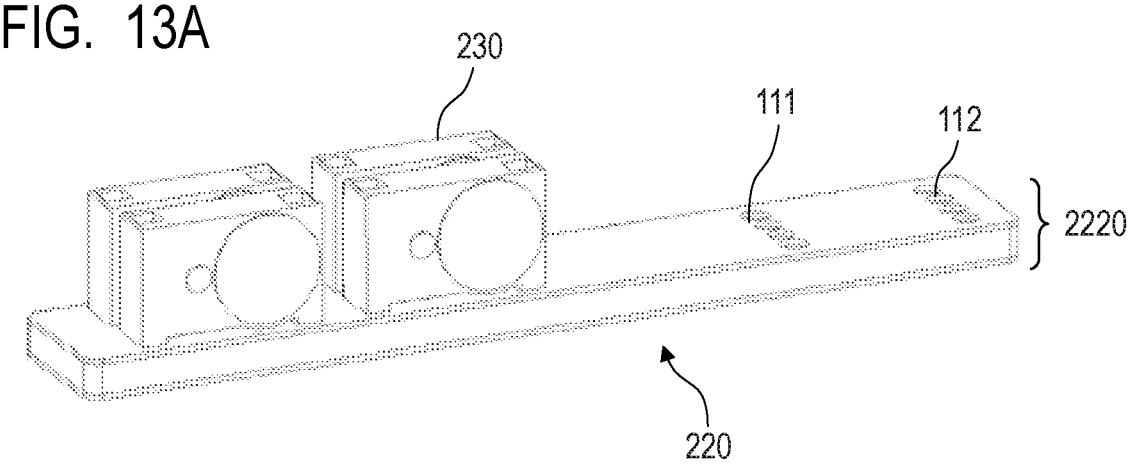
FIGS. 13A, 13B and 13C are schematic views of a liquid supplying unit pertaining to another embodiment.
Figure 13B:
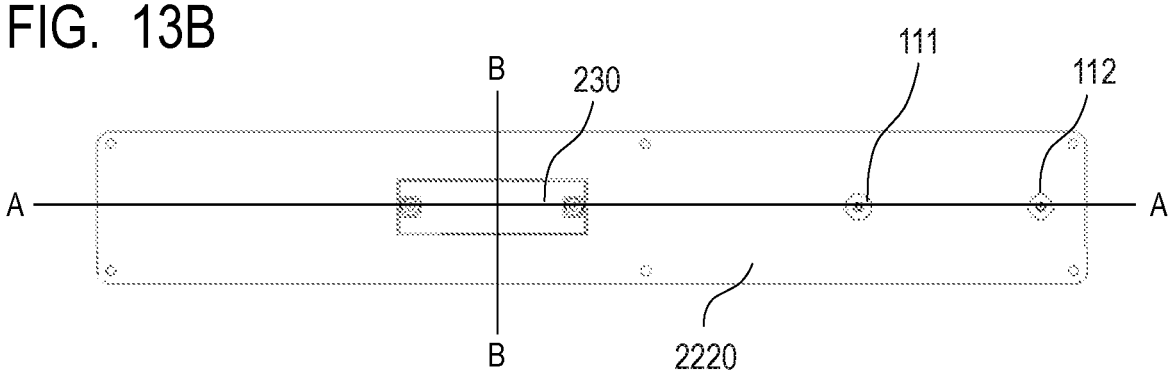
Figure 13C:
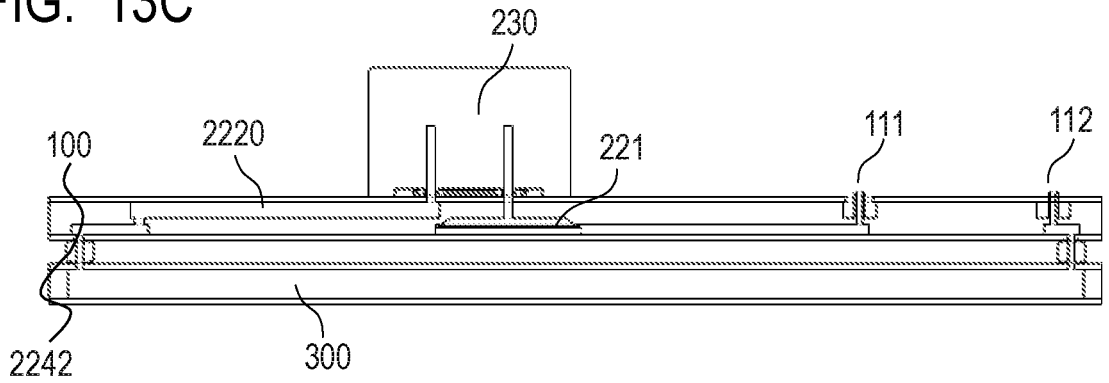

FIG. 12A is a perspective view of a liquid supplying unit 220 pertaining to an embodiment. FIG. 12B is a top view of the liquid supplying unit 220 shown in FIG. 12A, and FIG. 12C is a cross-sectional view taken along the line A-A in FIG. 12B. The liquid supplying unit 220 in the embodiment shown in FIGS. 12A to 12C supplies a single color ink and does not recover the ink supplied to a liquid ejection unit 300 (an ink is not circulated between the liquid ejection unit and the outside thereof). FIG. 13A is a perspective view of a liquid supplying unit 220 pertaining to another embodiment. FIG. 13B is a top view of the liquid supplying unit 220 shown in FIG. 13A, and FIG. 13C is a cross-sectional view taken along the line A-A in FIG. 13B. The liquid supplying unit 220 of the embodiment supplies a plurality of color inks and recovers the inks supplied to a liquid ejection unit 300 (inks are circulated between the liquid ejection unit and the outside thereof). In other words, inks are introduced from liquid connecting portions 111 to the liquid supplying unit 220 and are supplied from second connecting portions 2242 to a liquid ejection unit 300. The inks returned by circulation to the liquid supplying unit 220 are then recovered from liquid connecting portions 112 to a main body 1001. Not shown in the drawings, a liquid supplying unit 220 may supply a single color ink and may recover the ink supplied to a liquid ejection unit 300. A liquid supplying unit 220 may supply a plurality of color inks and may not recover the inks supplied to a liquid ejection unit 300. The following description is intended to describe the liquid supplying unit 220 having the structure shown in FIGS. 12A to 12C, but is also applicable to a liquid supplying unit 220 having another structure.

The liquid supplying unit 220 includes a liquid supplying member 2220, a negative pressure regulatory unit 230 provided on the liquid supplying member 2220, and a filter 221 provided in the liquid supplying member 2220. The liquid supplying member 2220 supplies an ink from a main body 1001 to a liquid ejection unit 300 (liquid ejection portion).

Figure 14A:
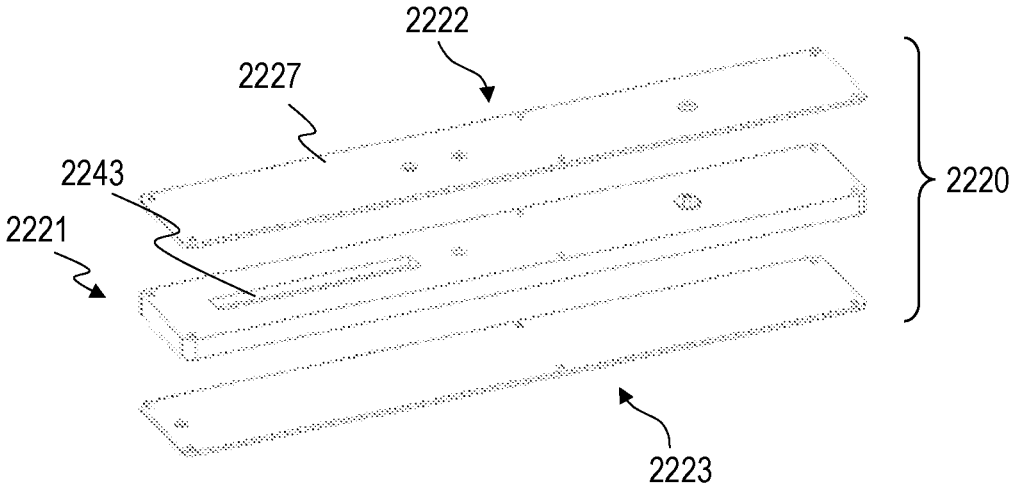
FIGS. 14A and 14B are exploded perspective views schematically showing a liquid supplying member.
Figure 14B:
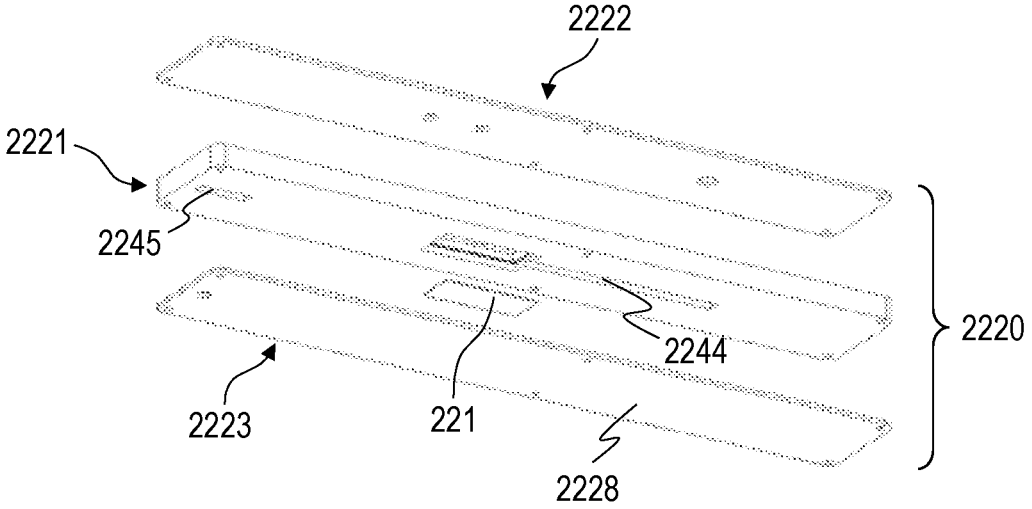

FIG. 14A is an exploded perspective view of the liquid supplying member 2220 viewed from the main body 1001 side, and FIG. 14B is an exploded perspective view of the liquid supplying member 2220 viewed from the liquid ejection unit 300 side. The liquid supplying member 2220 includes a first covering member 2222 that faces a main body 1001, a second covering member 2223 that faces a liquid ejection unit 300, and a flow path forming member 2221 interposed between the first covering member 2222 and the second covering member 2223. The first covering member 2222 has a first face 2227 that faces the main body 1001, and the second covering member 2223 has a second face 2228 that faces the liquid ejection unit 300. In other words, the liquid supplying member 2220 has the first face 2227 as the top face and the second face 2228 as the bottom face or the back face of the first face 2227. The first face 2227 is parallel with the second face 2228. The first face 2227 has a first connecting portion 2241 (FIG. 12C) fluidly connected to the main body 1001 and for supplying an ink to the liquid supplying member 2220. The second face 2228 has a second connecting portion 2242 (FIG. 12C) fluidly connected to the liquid ejection portion (liquid ejection unit 300) and for discharging (supplying) an ink to recording element substrates 10. The first connecting portion 2241 constitutes a liquid connecting portion 111 at the liquid ejection head 3 side.

The flow path forming member 2221 includes a first groove portion 2243 extending more closely to the first face 2227 than the second face 2228 and a second groove portion 2244 and a third groove portion 2245 each extending more closely to the second face 2228 than the first face 2227. The first covering member 2222 has the first face 2227 and covers the first groove portion 2243 to form a first liquid supplying channel 2249 together with the flow path forming member 2221. The second covering member 2223 has the second face 2228 and covers the second groove portion 2244 to form a second liquid supplying channel 2250 together with the flow path forming member 2221. The second covering member 2223 also covers the third groove portion 2245 to form a third liquid supplying channel 2251 together with the flow path forming member 2221. The first liquid supplying channel 2249 extends along the first face 2227 and the second liquid supplying channel 2250 and the third liquid supplying channel 2251 extend along the second face 2228. The flow path forming member 2221 has a first connecting channel 2246, a second connecting channel 2247, and a third connecting channel 2248 each penetrating the flow path forming member 2221 in the thickness direction, i.e., from the first face 2227 to the second face 2228. The first connecting portion 2241 communicates with the second liquid supplying channel 2250 through the first connecting channel 2246. The second liquid supplying channel 2250 communicates with the first liquid supplying channel 2249 through the second connecting channel 2247 and the negative pressure regulatory unit 230. The first liquid supplying channel 2249 communicates with the second connecting portion 2242 through the third connecting channel 2248 and the third liquid supplying channel 2251. By extending the first liquid supplying channel 2249 directly above the second connecting portion 2242, the third liquid supplying channel 2251 can be eliminated. As shown in FIG. 16B, between the second connecting channel 2247 and the negative pressure regulatory unit 230, a fourth liquid supplying channel 2252 extending more closely to the first face 2227 than the second face 2228 may be provided. With such a structure, the liquid supplying member 2220 has an interior channel that communicates the first connecting portion 2241 and the second connecting portion 2242 through the negative pressure regulatory unit 230. The interior channel includes the first to third liquid supplying channels 2249 to 2251 and the first to third connecting channels 2246 to 2248. The first connecting channel 2246, the second connecting channel 2247, and the third connecting channel 2248 extend in a direction intersecting the first face 2227 and the second face 2228.

An ink flows from the first connecting portion 2241 through the first connecting channel 2246 and is supplied to the second liquid supplying channel 2250. The ink flows through the second liquid supplying channel 2250, the filter 221, and the second connecting channel 2247 and is introduced into the negative pressure regulatory unit 230. The negative pressure regulatory unit 230 adjusts the pressure of the ink, and the ink is supplied to the first liquid supplying channel 2249. The ink then flows through the third connecting channel 2248 and the third liquid supplying channel 2251 and is discharged from the second connecting portion 2242 to the liquid ejection unit 300. As described above, the interior channel includes, for the liquid flow from the first connecting portion 2241 to the second connecting portion 2242, a portion extending toward the first face 2227 and portions extending toward the second face 2228. The portion extending toward the first face 2227 is the second connecting channel 2247, and the portions extending toward the second face 2228 are the first connecting channel 2246 and the third connecting channel 2248. In other words, an ink flows from the first face 2227 side to the second face 2228 side, then is returned to the first face 2227 side, and flows to the second face 2228 side again. Hence, the filter 221 can be provided in the liquid supplying member 2220, and the negative pressure regulatory unit 230 can be provided on the first face 2227 of the liquid supplying member 2220. Accordingly, the number of components can be reduced. Due to such an interior channel structure as to have vertically up and down portions, bubbles in the interior channel are likely to separate an ink, and the ink volume to the first connecting portion 2241 can be reduced. Hence, the ink leakage from the liquid connecting portion 111 (first connecting portion 2241) by tilt of the liquid ejection head 3 or a drop impact can be suppressed when the liquid ejection head 3 is removed from a main body 1001.

The interior channel structure of the liquid supplying member 2220 is not limited to the above and may be any structure having a portion extending toward the first face 2227 and a portion extending toward the second face 2228. For example, the first to third liquid supplying channels 2249 to 2251 may slope toward the first face or the second face 2228, and in such a case, some of the first to third connecting channels 2246 to 2248 may be eliminated. The first to third connecting channels 2246 to 2248 are not necessarily orthogonal to the first face and the second face 2228 and may be inclined relative to a perpendicular line of the first face and the second face 2228. Also in this case, an inclined connecting channel extends toward the first face 2227 or the second face 2228. The number of bends of the interior channel is not limited, and an interior channel may be folded any number of times between the first face and the second face 2228.

Figure 15A:
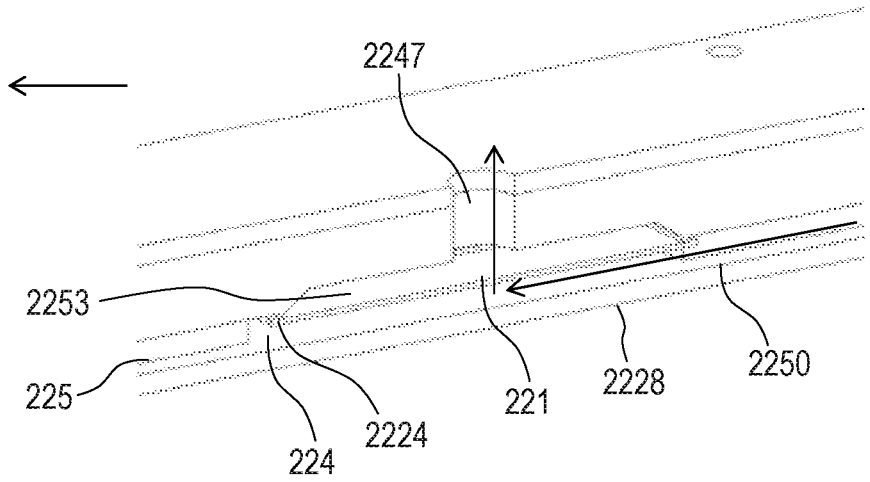
FIGS. 15A and 15B are perspective views each showing a filter attached to a liquid supplying member.

FIG. 15A is a partial perspective view of the liquid supplying member 2220, showing the vicinity of the filter 221. The filter 221 is provided on the boundary between the second connecting channel 2247 and the second liquid supplying channel 2250. The filter 221 has a larger resistance than other portions of the interior channel, and the pressure loss is large when a liquid passes through the filter. To stabilize the pressure, the channel area of the filter 221 is larger than those of other portions of the interior channel. In other words, the second connecting channel 2247 has a cross-section enlarged section 2253 for accommodating the filter 221, and the filter 221 is provided in the cross-section enlarged section 2253. The second connecting channel 2247 more easily includes the cross-section enlarged section 2253 than the first liquid supplying channel 2249 or the second liquid supplying channel 2250. The filter 221 is preferably provided at the upstream side of the negative pressure regulatory unit 230. When an ink passes through the filter 221 as a resistive component and then the ink pressure is adjusted by the negative pressure regulatory unit 230, pressure fluctuations in channels from the pressure regulatory system 232 to the recording element substrates 10 can be further suppressed.

Figure 15B:
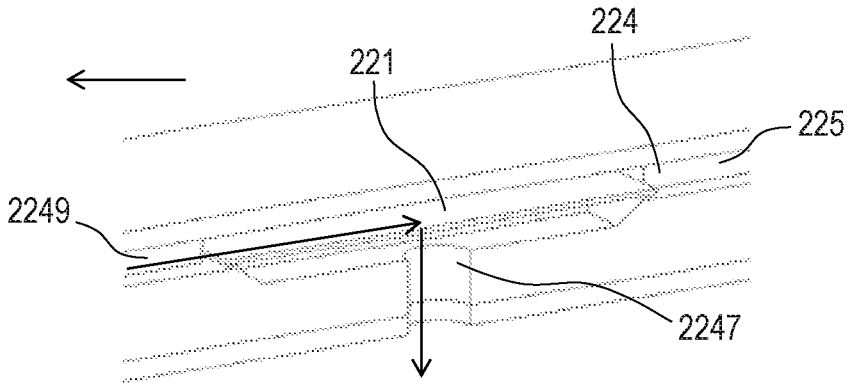

The flow path forming member 2221 has a filter supporting portion 2224 for supporting the filter 221. The filter supporting portion 2224 faces the second face 2228. In other words, the filter 221 is pushed in the same direction as the ink flow direction and is joined. The ink pressure is applied in the direction of pushing the filter 221 to the filter supporting portion 2224, and thus the bonding reliability is achieved. The flow of an ink passing through the filter 221 is preferably in the vertically upward direction. By allowing an ink to flow from the bottom to the top of the filter 221, air discharged from an install portion of the filter 221 is likely to move upward by buoyancy and an ink flow, and thus bubbles are more reliably discharged. Hence, bubbles are prevented from staying in the install portion of the filter 221, and the effective area of the filter 221 can be more reliably achieved. As shown in FIG. 15B, the interior channel structure can be changed to provide a filter 221 on the boundary between a second connecting channel 2247 and a first liquid supplying channel 2249, but the structure in FIG. 15A is more preferred from the viewpoint of prevention of bubble staying. At the downstream side of the filter 221, a vent 224 is preferably formed. Bubbles just before the filter 221 can be discharged through the vent 224 and a bypass channel 225. This structure can suppress microbubbles generated when bubbles pass through the filter 221.

Figure 16A:
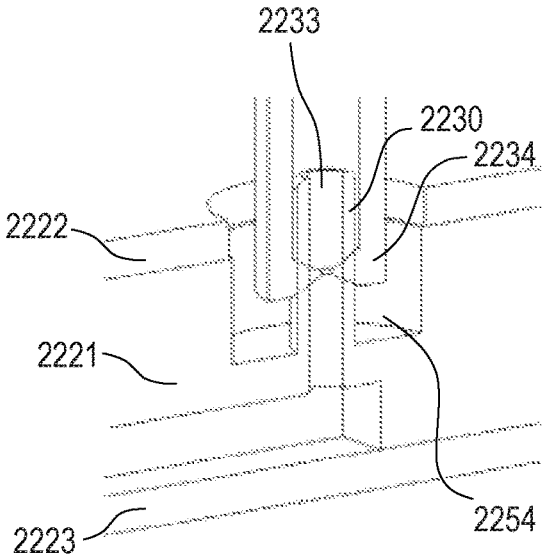
FIGS. 16A, 16B and 16C are schematic perspective views each showing a connecting portion between a liquid supplying member and a main body pertaining to an embodiment.
Figure 16B:
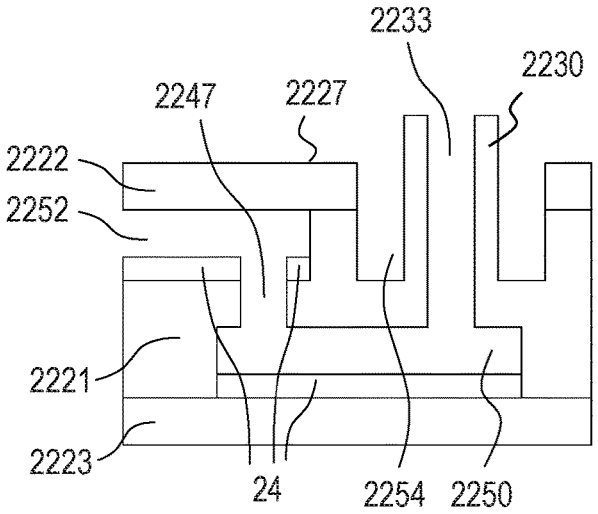
Figure 16C:
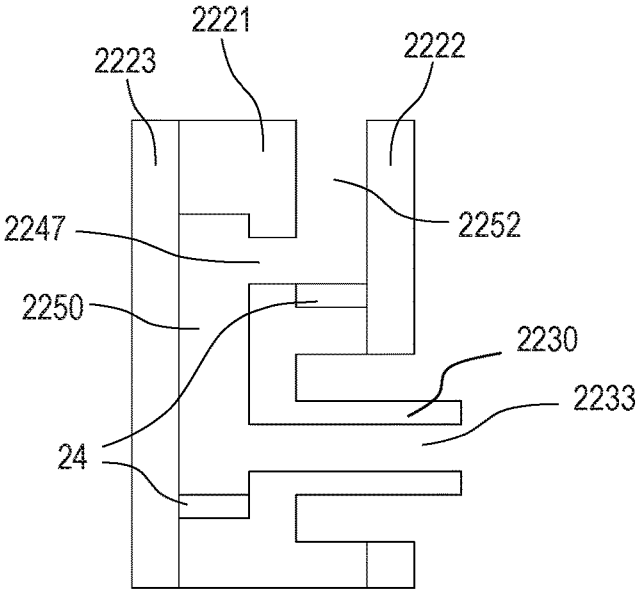
Figure 17A:
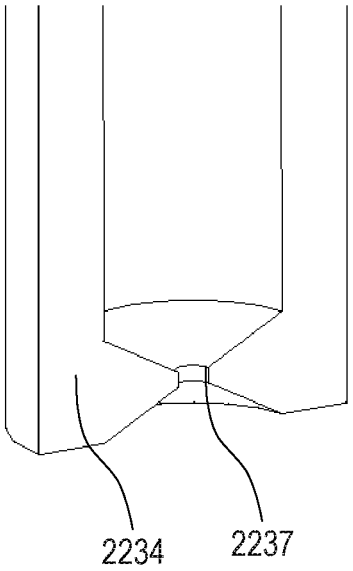
FIGS. 17A and 17B are perspective views each showing an embodiment of a cylindrical joint rubber at the main body side.
Figure 17B:
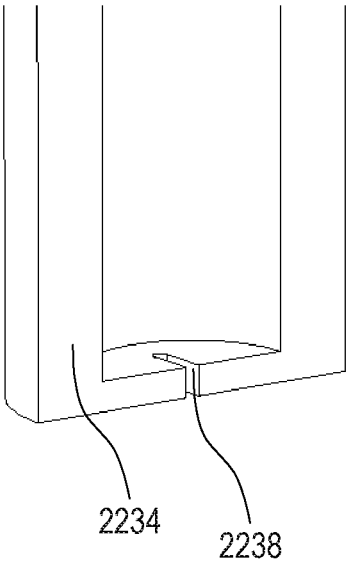

FIGS. 16A to 16C are views showing the structure of a first cylindrical portion (joint) 2230. FIG. 16A is a perspective view showing the vicinity of a first cylindrical portion 2230, and FIG. 16B is a side view thereof. The liquid supplying member 2220 has a first cylindrical portion 2230. The first cylindrical portion 2230 is provided in a concave portion 2254 having an opening on the first face 2227. The first cylindrical portion 2230 constitutes the first connecting portion 2241 and the first connecting channel 2246. The first cylindrical portion 2230 has a circular channel 2233 therein and is a cylinder having a cylindrical outer surface. By providing the first cylindrical portion 2230 in the flow path forming member 2221, the protrusion of the first cylindrical portion 2230 from the first face 2227 can be reduced. In addition, the first covering member 2222 can be formed from a low rigidity part or a thin part such as a film, and thus such a structure has an advantage in downsizing. The periphery of a part of the first cylindrical portion 2230 constituting the first connecting channel 2246 or a part of the first cylindrical portion 2230 substantially facing the flow path forming member 2221 is covered with a joint rubber (second cylindrical portion) 2234. The joint rubber 2234 is provided on the main body 1001 and is fitted to the outer face of the first cylindrical portion 2230. FIGS. 17A and 17B are schematic perspective views of joint rubbers 2234. On the tip of a joint rubber 2234, a pore 2237 shown in FIG. 17A or a long opening or bite 2238 shown in FIG. 17B is formed (collectively called opening). The opening of the joint rubber 2234 can be enlarged by elastic deformation. By inserting the first cylindrical portion 2230 into the opening of the joint rubber 2234 while the opening is enlarged, the first cylindrical portion is in close contact with the opening to prevent ink leakage. The opening shrinks when the first cylindrical portion 2230 is removed from the joint rubber 2234. This forms a meniscus on the opening at the tip of the joint rubber 2234, and thus the ink leakage from the main body 1001 is suppressed. The opening of the joint rubber 2234 may be configured to be completely closed when the first cylindrical portion 2230 is removed from the joint rubber 2234.

In the present embodiment, the first cylindrical portion 2230 is fluidly connected to the second liquid supplying channel 2250, and the second liquid supplying channel 2250 is fluidly connected through the second connecting channel 2247 and the negative pressure regulatory unit 230 to the first liquid supplying channel 2249. When the liquid ejection head 3 is removed from the main body 1001, the ink in the liquid ejection head 3 is preferably discharged to some extent by capping the ejection port of the liquid ejection head 3 and then aspirating the ink, for example. Some air is accordingly introduced into the interior channel in the liquid ejection head 3. Hence, at the time of replacement of the liquid ejection head 3, the ink 24 left in the interior channel of the liquid ejection head 3 is separated by the air left in the channels in the second connecting channel 2247 or at the boundary between the cylindrical channel 2233 and the second liquid supplying channel 2250, as shown in FIG. 16B. The ink volume in the channels continuing from the liquid connecting portion 111 can be reduced, and thus the ink leakage from the liquid connecting portion 111 can be suppressed. For example, if the ink in an interior channel is aspirated from a liquid ejection head 3 in which the interior channel extends from the top to the bottom in one direction, the ink continuously flows from the main body 1001 and the ink in the interior channel cannot be removed. In contrast, in the present embodiment, an ink stays on the bottom of a portion lower than the periphery, such as the second connecting channel 2247, whereas the upper area is substituted by air. Hence, an ink influx is prevented, and the ink is separated. As shown in FIG. 16C, when the first cylindrical portion 2230 is placed in the horizontal direction, the ink 24 is also separated by bubbles left in the channels in the second connecting channel 2247 or at the boundary between the cylindrical channel 2233 and the second liquid supplying channel 2250. Hence, the ink leakage from the liquid connecting portion 111 can be suppressed.

Figure 18A:
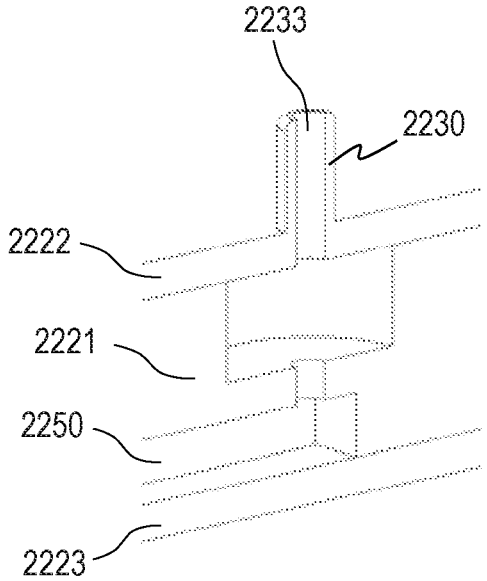
FIGS. 18A, 18B and 18C are schematic perspective views each showing a connecting portion between a liquid supplying member and a main body pertaining to another embodiment.
Figure 18B:
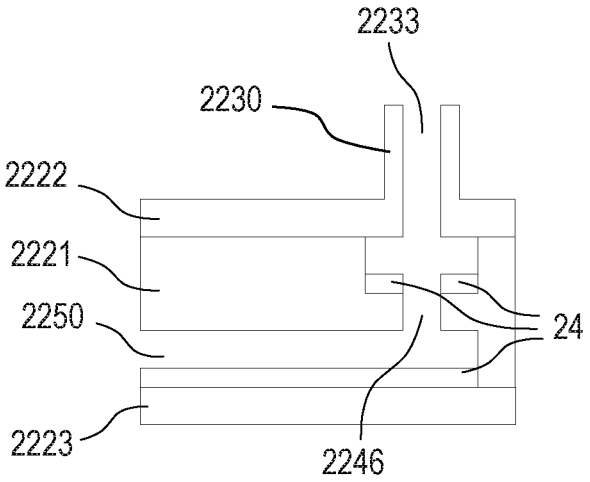
Figure 18C:
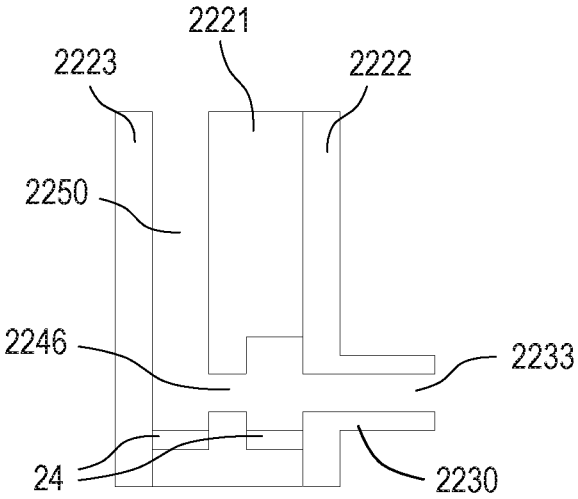

FIG. 18A is a perspective view showing the vicinity of a liquid connecting portion 111 in another embodiment, and FIG. 18B is a side view thereof. A first cylindrical portion 2230 protrudes from a first face 2227 of a first covering member 2222 and constitutes a first connecting portion 2241. The first cylindrical portion 2230 is fluidly connected through a first connecting channel 2246 to a second liquid supplying channel 2250, and the second liquid supplying channel 2250 is fluidly connected through a second connecting channel 2247 and a negative pressure regulatory unit 230 to a first liquid supplying channel 2249. Hence, the ink leakage from the liquid connecting portion 111 can be suppressed for the above reason. As shown in FIG. 18C, the first cylindrical portion 2230 can be placed in the horizontal direction. Also in this case, the ink leakage from the liquid connecting portion 111 can be suppressed for a similar reason.

As shown in FIGS. 19A to 19F, a first cylindrical portion 2230 can be provided on a main body 1001. In the example shown in FIG. 19A, a cylindrical joint rubber 2234 is provided in a liquid supplying member 2220 and has an opening 2239 into which the first cylindrical portion 2230 is inserted while the first cylindrical portion is in close contact with the joint rubber. The joint rubber 2234 is provided between a first covering member 2222 and a flow path forming member 2221. In the example shown in FIG. 19B, a joint rubber 2234 is provided on a first face 2227 of a liquid supplying member 2220, and the joint rubber 2234 is held between a rubber joint cover 2235 and the liquid supplying member 2220. In the example, the number of parts increases as compared with the example shown in FIG. 19A, but the fitting property of the cylindrical joint rubber 2234 is advantageously improved.

Without any cylindrical channel 2233, an elastic body may be interposed between a main body 1001 and a liquid ejection head 3 to constitute a joint. In the example shown in FIG. 19C, a joint rubber 2236 is a torus having an opening. The joint rubber 2236 has a convex shape at each end and is interposed between a first face 2227 of a first covering member 2222 of a liquid supplying member 2220 and a flat plate 2240 fixed to a main body 1001. When a main body 1001 has a flat face facing the joint rubber 2236, the flat plate 2240 can be eliminated. The flat plate 2240 has a hole communicating with the opening of the joint rubber 2236. The joint rubber 2236 can be separated from the flat plate 2240 and the liquid ejection head 3 or can be joined with one of the flat plate 2240 and the liquid ejection head 3.

Figure 19A:
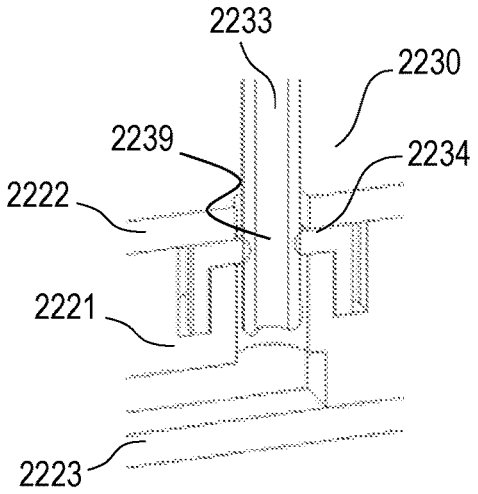
FIGS. 19A, 19B, 19C, 19D, 19E and 19F are schematic perspective views each showing a connecting portion between a liquid supplying member and a main body pertaining to another embodiment.
Figure 19B:
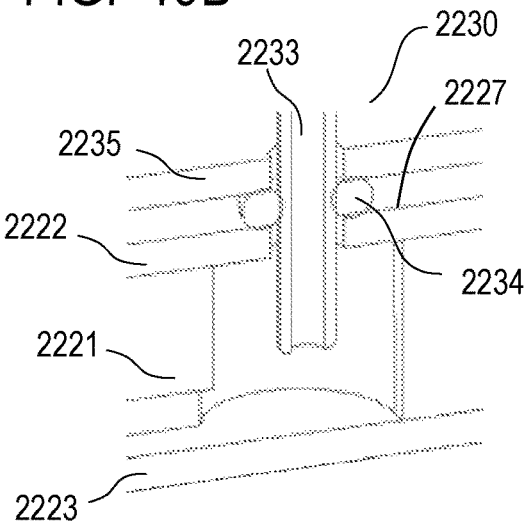
Figure 19C:
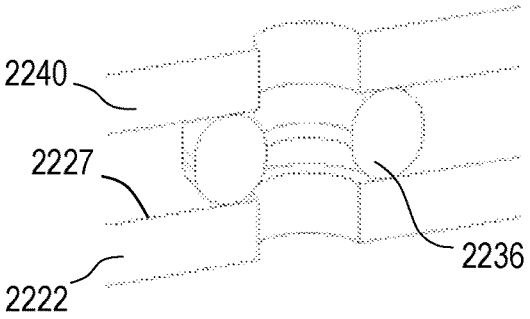
Figure 19D:
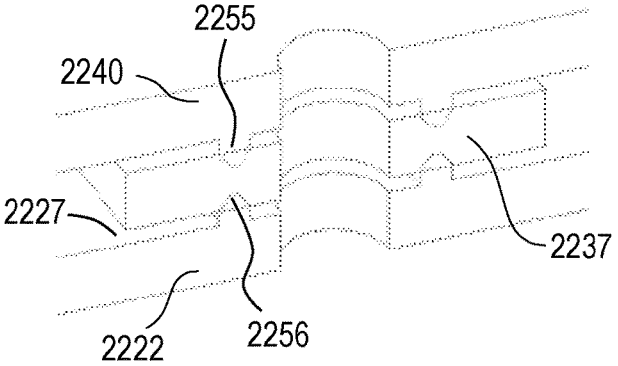
Figure 19E:
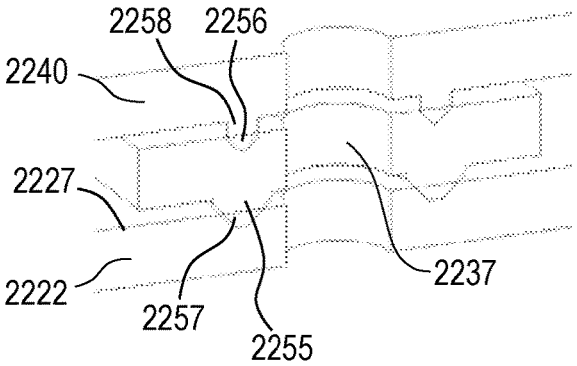
Figure 19F:
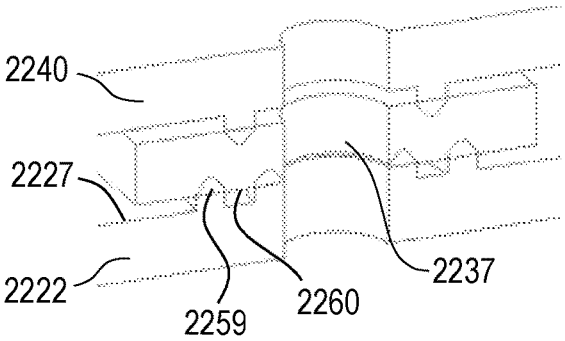

In the example shown in FIG. 19D, a plate-shaped joint rubber 2237 is interposed between a flat plate 2240 and a first covering member 2222. Convex portions 2255 are formed on a first face 2227 of a liquid supplying member 2220 and a face of the flat plate 2240 facing the joint rubber 2237. Concave portions 2256 fitting the convex portions 2255 are formed on the joint rubber 2237, on a face facing the first face 2227 and a face facing the flat plate 2240. As shown in FIG. 19E, a convex portion 2255 may be formed on a joint rubber 2237 on a face facing a first face 2227 of a liquid supplying member 2220, and a concave portion 2256 may be formed on a face facing a flat plate 2240. In this case, a concave portion 2257 fitting the convex portion 2255 is formed on the liquid supplying member 2220 on the first face 2227, and a convex portion 2258 fitting the concave portion 2256 is formed on the flat plate 2240 on a face facing the joint rubber 2237. Alternatively, a concave portion may be formed on a joint rubber 2237 on a face facing a first face 2227 of a liquid supplying member 2220, and a convex portion may be formed on a face facing a flat plate 2240. Alternatively, as shown in FIG. 19F, a plurality of radially arranged convex portions 2259 may be provided on one of a joint rubber 2237 and a first face 2227 of a liquid supplying member 2220 (or a flat plate 2240), and convex portions 2260 fitting them may be provided on the other. In each example shown in FIGS. 19A to 19F, the ink leakage from the liquid connecting portion 111 can be suppressed for the above reason.

(Detailed Description of Negative Pressure Regulatory Unit)

Figure 20A:
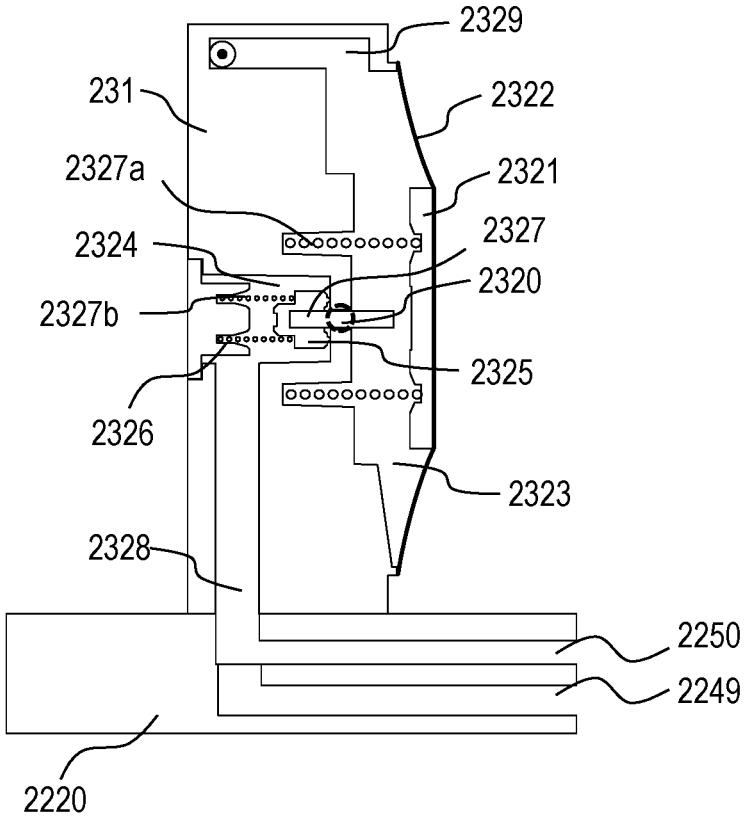
FIGS. 20A and 20B are schematic cross-sectional views of a pressure regulatory system pertaining to an embodiment.
Figure 20B:
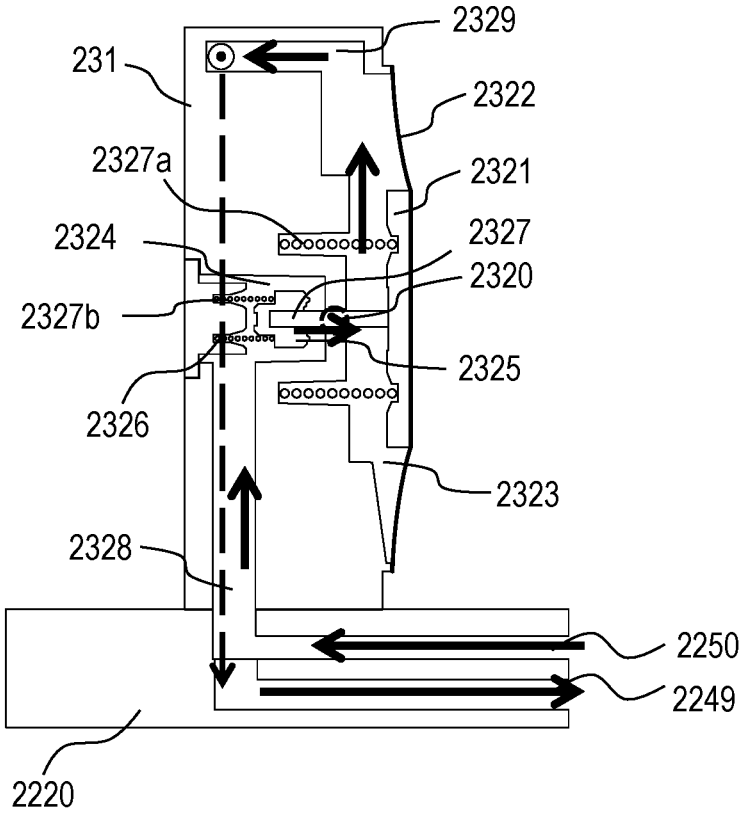

The negative pressure regulatory unit 230 will next be described in detail. FIGS. 20A and 20B are cross-sectional views taken along the line B-B in FIG. 13B. FIG. 20A shows the state in which a valving element 2325 of a pressure regulatory system 232 provided in a negative pressure regulatory unit 230 is closed to deactivate pressure control. FIG. 20B shows the state in which the valving element 2325 of the pressure regulatory system 232 is opened to activate pressure control. The negative pressure regulatory unit 230 is installed on the first face 2227 of the liquid supplying member 2220. The negative pressure regulatory unit 230 includes a casing 231 and a flexible film 2322 fixed to the casing 231 to keep air-tightness and fluid-tightness. In the inner space defined by the casing 231 and the flexible film 2322 of the negative pressure regulatory unit 230, the following components are provided.

In the casing 231, an upstream channel 2328 and a downstream channel 2329 of the negative pressure regulatory unit 230 are formed. The upstream channel 2328 communicates through the interior channel in the liquid supplying member 2220 with the first connecting portion 2241, and the downstream channel 2329 communicates through the interior channel in the liquid supplying member 2220 with the second connecting portion 2242. Between the flexible film 2322 and the casing 231, a pressure regulatory chamber 2323 separated by the flexible film 2322 from the outside is formed. Onto the inner face of the flexible film 2322 or the face on the pressure regulatory chamber 2323 side, a pressure bearing plate 2321 is fixed. The pressure regulatory chamber 2323 fluidly communicates with the downstream channel 2329 and accordingly communicates with the second connecting portion 2242. Between the pressure bearing plate 2321 and the casing 231, a first spring 2327*a* is provided. The first spring 2327*a* biases the pressure bearing plate 2321 and the flexible film 2322 in the separating direction from the casing 231 or the direction of increasing the volume of the pressure regulatory chamber 2323 (outward direction).

In the casing 231, a liquid communicating chamber 2324 is formed. The liquid communicating chamber 2324 fluidly communicates with the upstream channel 2328 and accordingly communicates with the first connecting portion 2241. On the boundary between the liquid communicating chamber 2324 and the pressure regulatory chamber 2323 in the casing 231, an orifice 2320 through which an ink can flow is provided. In the liquid communicating chamber 2324 at a position facing the orifice 2320, a valving element 2325 is stored. In other words, the valving element 2325 is provided at the upstream side of the orifice 2320 in terms of ink flow. To the casing 231, a spring seat 2326 is fixed, and a second spring 2327*b* is provided between the spring seat 2326 and the valving element 2325. The second spring 2327*b* biases the valving element 2325 against the orifice 2320 or in the direction of closing the orifice 2320. The valving element 2325 is connected to a shaft 2327 penetrating the orifice 2320. Specifically, one end of the shaft 2327 is fixed to the valving element 2325 by an appropriate fixing means such as adhesion and press fitting, and the shaft 2327 can move integrally with the valving element 2325. The other end of the shaft 2327 is not connected to the pressure bearing plate 2321. With this structure, the pressure regulatory chamber 2323 can function as a buffer to absorb a pressure generated by bubble expansion or the like at the downstream side. The shaft 2327 has a smaller diameter than that of the orifice 2320 so that the valving element 2325 can move relative to the orifice 2320.

When an ink does not circulate, the valving element 2325 is in close contact with the orifice 2320 (the valving element 2325 is closed) as shown in FIG. 20A, and the communication between the orifice 2320 and the liquid communicating chamber 2324 is interrupted. Accordingly, the communication between the liquid communicating chamber 2324 and the pressure regulatory chamber 2323 is also interrupted. The shaft 2327 is spaced apart from the pressure bearing plate 2321. When an ink is circulating, the valving element 2325 is spaced apart from the orifice 2320 (shifted to the left in FIG. 20B), and a gap is formed between the orifice 2320 and the valving element 2325 as shown in FIG. 20B. The orifice 2320 communicates with the liquid communicating chamber 2324 through the gap. Accordingly, the upstream channel 2328 communicates with the pressure regulatory chamber 2323. The shaft 2327 comes into contact with the pressure bearing plate 2321 to press the pressure bearing plate 2321. Accordingly, the first spring 2327*a* and the second spring 2327*b* form a coupling (composite) spring. In the following description, the channel formed by the valving element 2325 and the orifice 2320 is called a valve portion. The state in which the gap is formed between the valving element 2325 and the orifice 2320 is considered a state in which the valving element 2325 opens, whereas the state in which the valving element 2325 is in close contact with the orifice 2320 is considered a state in which the valving element 2325 closes. When the valving element 2325 opens, an ink introduced from the upstream channel 2328 into the liquid communicating chamber 2324 passes through the gap between the valving element 2325 and the orifice 2320 and flows in the pressure regulatory chamber 2323 to transmit the pressure to the pressure bearing plate 2321. The ink is then discharged to the downstream channel 2329.

The pressure P2 in the pressure regulatory chamber 2323 is determined in accordance with the following equation that shows the equilibrium of forces applied to portions.

$$P2=(P0\cdot Sd-(P1\cdot Sv+kx))/(Sd-Sv) \quad \text{(Equation 1)}$$

In the equation, Sd is the pressure bearing area of a pressure bearing plate 2321, Sv is the pressure bearing area of a valving element 2325, P0 is the atmospheric pressure, P1 is the pressure in a liquid communicating chamber 2324 (pressure at the orifice upstream side), k is a spring constant, and x is a spring displacement. The spring constant k is a composite spring constant of the first spring 2327*a* and the second spring 2327*b*. In the present embodiment, as the biasing system for biasing the valving element 2325 in the closing direction, a coupling system of two springs 2327*a*, 2327*b* is adopted. However, if the pressure P2 in the pressure regulatory chamber 2323 can be an intended negative pressure value, only one of the springs can be used to constitute the biasing system of the valving element 2325. By setting the respective spring constants of a first spring 2327*a* and a second spring 2327*b* as the biasing system, the pressure P1 in the liquid communicating chamber 2324 communicating with the upstream channel 2328 can be set at an intended pressure.

When the flow channel resistance of a valve portion is R, and the flow rate of an ink passing through the orifice 2320 is Q, the following equation is established.

$$P2=P1-QR \quad \text{(Equation 2)}$$

Figure 21:
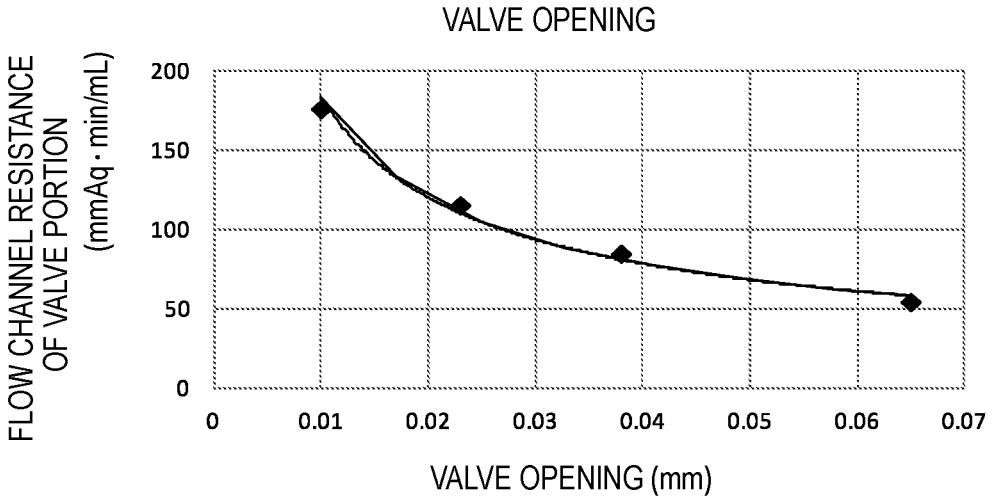
FIG. 21 is a graph showing the relation between opening of a valving element and flow channel resistance of a valve portion.

In an embodiment, a valve portion is so designed as that the flow channel resistance R thereof and the opening of the valving element 2325 satisfy such a relation as in FIG. 21, for example. In other words, as the opening of the valving element 2325 increases, the flow channel resistance R decreases. By positioning the valving element 2325 so as to simultaneously satisfy (Equation 1) and (Equation 2), the pressure P2 in the pressure regulatory chamber 2323 is determined.

The pressure of a pressurizing source (second circulation pump 1004) connected to an upstream point of the pressure regulatory system 232 is constant. Here, the case in which the flow rate Q of an ink flowing in the upstream channel 2328 of the pressure regulatory system 232 increases is assumed. When the flow rate Q increases, the flow channel resistance from the pressure regulatory system 232 to the buffer tank 1003 increases. The pressure P1 in the pressure regulatory chamber 2323 decreases by the increase of the flow channel resistance. As a result, the force opening the valving element 2325, P1·Sv, decreases, and the pressure P2 in the pressure regulatory chamber 2323 instantaneously increases in accordance with (Equation 1).

Meanwhile, (Equation 2) derives the relation R=(P1−P2)/Q. The flow rate Q and the pressure P2 in the pressure regulatory chamber increase, and the pressure P1 at the upstream side of the orifice 2320 decreases. Hence, the flow channel resistance R decreases. A reduction of the flow channel resistance R means an increase in opening of the valving element 2325 as shown in FIG. 21. As shown in FIG. 20B, when the opening of the valving element 2325 increases, the first spring 2327*a* and the second spring 2327*b* shorten. Accordingly, the displacement from a natural length, x, increases, and the acting force of the first spring 2327*a* and the second spring 2327*b*, kx, increases. As apparent from (Equation 1), thus, the pressure P2 in the pressure regulatory chamber 2323 instantaneously decreases. When the pressure P2 in the pressure regulatory chamber 2323 instantaneously decreases, the pressure P2 in the pressure regulatory chamber 2323 increases in the next moment by the opposite action to the above. In this manner, by instantaneously repeating pressure changes to satisfy both (Equation 1) and (Equation 2) while the opening of the valving element 2325 varies with the flow rate Q, the pressure P2 in the pressure regulatory chamber 2323 is controlled at a constant value. As shown in FIG. 20A, the downstream channel 2329 is connected at the vertically upper side relative to the pressure regulatory chamber 2323, and thus bubbles in the pressure regulatory chamber 2323 are prevented from staying. Hence, the movement of the pressure bearing plate 2321 is unlikely to be disturbed by bubbles, and thus the pressure P2 in the pressure regulatory chamber 2323 can be stabilized.

Figure 22:
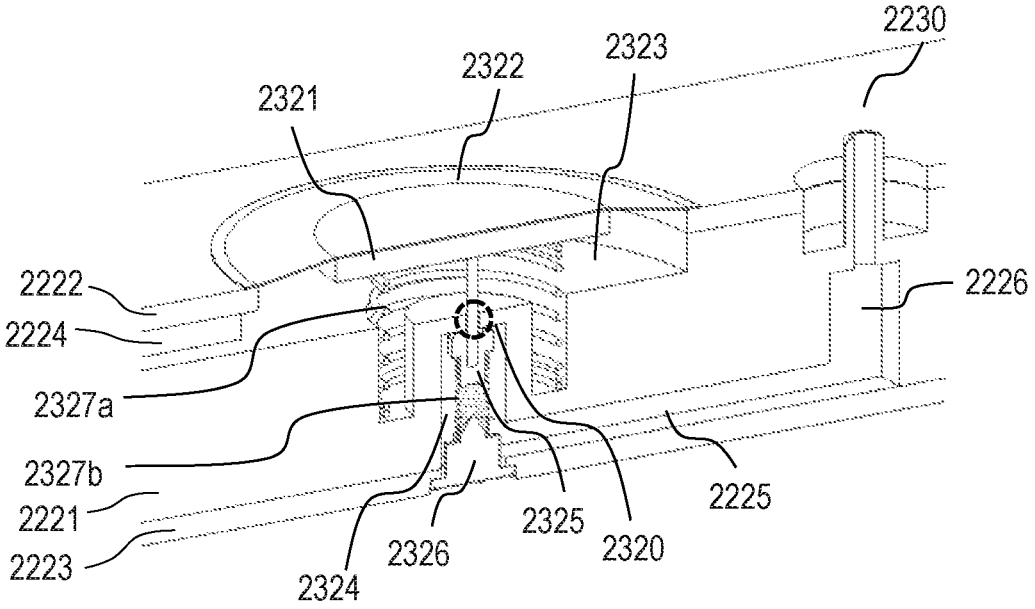
FIG. 22 is a schematic cross-sectional view of a pressure regulatory system pertaining to another embodiment.

The pressure regulatory system 232 can be embedded in the liquid supplying member 2220. FIG. 22 shows a pressure regulatory system 232 embedded in a liquid supplying member 2220. A flow path forming member 2221 is used as a casing 231, and a second liquid supplying channel 2250 has an orifice 2320. With this structure, a pressure regulatory system 232 can be provided in a liquid supplying member 2220, and the number of parts can be reduced. A pressure regulatory chamber 2323 may be provided on either the first covering member 2222 side or the second covering member 2223 side, but a flexible film 2322 is more preferably provided on the second covering member 2223 side. If a pressure regulatory chamber 2323 is provided on the first covering member 2222 side, bubbles may come into contact with a pressure bearing plate 2321 of the pressure regulatory chamber 223 to fluctuate the pressure bearing area Sd of the pressure bearing plate 2321, and the pressure control may be unstable. By providing the flexible film 2322 downward or at the second covering member 2223 side, bubbles can be removed from the pressure bearing plate 2321 by buoyancy.

According to the present invention, the interior channel includes a portion extending toward the first face of the interior channel and a portion extending toward the second face. The liquid in the interior channel is thus likely to be separated by bubbles present in or flowing into the interior channel. Hence, even when a liquid leaks from a first connecting portion by tilt or an impact of a liquid ejection head being removed from a main body of a recording apparatus, the leakage amount can be reduced. According to the present invention, a liquid ejection head that is removably attached to a main body of a recording apparatus and can suppress the amount of a liquid that may leak from a connecting portion to the main body when the liquid ejection head is detached from the main body can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127485, filed Jun. 29, 2017, which is hereby incorporated by reference herein in its entirety.

What is claimed is:

1. A liquid ejection head removably attached to a recording apparatus, the liquid ejection head comprising:

a liquid ejection portion configured to eject a liquid; and a liquid supplying member including a first face having a first connecting portion fluidly connected to the recording apparatus, a second face that is a back face of the first face and has a second connecting portion fluidly connected to the liquid ejection portion, and an interior channel communicating the first connecting portion and the second connecting portion, the liquid supplying member supplying a liquid from the recording apparatus to the liquid ejection portion, wherein the interior channel includes, for a flow of the liquid from the first connecting portion to the second connecting portion, a portion extending toward the first face and a portion extending toward the second face, wherein the interior channel includes a first liquid supplying channel extending along the first face, a second liquid supplying channel extending along the second face, a first connecting channel communicating the first connecting portion and the second liquid supplying channel and extending in a direction intersecting the first face, a second connecting channel communicating the second liquid supplying channel and the first liquid supplying channel and extending in a direction intersecting the first face, and a third connecting channel communicating the first liquid supplying channel and the second connecting portion and extending in a direction intersecting the first face, and wherein the liquid supplying member includes a channel member including a first groove portion extending more closely to the first face than the second face, a second groove portion extending more closely to the second face than the first face, the first connecting channel, the second connecting channel, and the third connecting channel, a first covering member having the first face, covering the first groove portion, and defining, together with the channel member, the first liquid supplying channel, and a second covering member having the second face, covering the second groove portion, and defining, together with the channel member, the second liquid supplying channel.

2. The liquid ejection head according to claim 1, wherein the first liquid supplying channel is located more closely to the first face than the second face, and the second liquid supplying channel is located more closely to the second face than the first face.

3. The liquid ejection head according to claim 1, further comprising a filter in the interior channel.

4. The liquid ejection head according to claim 3, wherein the filter is located in the second connecting channel.

5. The liquid ejection head according to claim 4, wherein the liquid supplying member has a filter supporting portion supporting the filter, and the filter supporting portion faces the second face.

6. The liquid ejection head according to claim 4, wherein the second connecting channel has a section with an enlarged cross-section for accommodating the filter.

7. The liquid ejection head according to claim 1, further comprising at least one pressure regulatory system, wherein the pressure regulatory system includes a liquid communicating chamber communicating with the first connecting portion, a pressure regulatory chamber communicating with the second connecting portion, an orifice located on a boundary between the liquid communicating chamber and the pressure regulatory chamber, a valving element provided in the liquid communicating chamber and facing the orifice, a biasing system configured to bias the valving element against the orifice, a flexible film dividing the pressure regulatory chamber from outside, a pressure bearing plate attached to an inner face of the flexible film, and a shaft penetrating the orifice and having one end fixed to the valving element.

8. The liquid ejection head according to claim 7, wherein the pressure regulatory system is provided on the first face of the liquid supplying member.

9. The liquid ejection head according to claim 7, wherein the pressure regulatory system is embedded in the liquid supplying member.

10. The liquid ejection head according to claim 1, further comprising a first cylindrical portion provided in a concave portion that has an opening on the first face and constituting the first connecting portion and the first connecting channel.

11. A recording apparatus comprising:

the liquid ejection head according to claim 10; and a second cylindrical portion fitted to an outer face of the first cylindrical portion, wherein the second cylindrical portion has a tip with an opening, the opening is elastically deformable such that the first cylindrical portion is inserted into the opening, and the opening shrinks when the first cylindrical portion is removed from the second cylindrical portion.

12. The liquid ejection head according to claim 1, further comprising a first cylindrical portion protruding from the first face and constituting the first connecting portion.

13. The liquid ejection head according to claim 1, further comprising a joint rubber provided on a periphery of the first connecting channel, wherein the joint rubber has an opening, and a cylindrical portion of the recording apparatus is inserted into the opening while the cylindrical portion is in close contact with the joint rubber.

14. The liquid ejection head according to claim 13, wherein the joint rubber is a torus having the opening.

15. The liquid ejection head according to claim 1, further comprising a joint rubber provided on the first face of the liquid supplying member, and a joint cover holding the joint rubber interposed between the joint cover and the liquid supplying member, wherein the joint rubber and the joint cover have openings, and a cylindrical portion of the recording apparatus is inserted into the openings while the cylindrical portion is in close contact with the joint rubber.

16. The liquid ejection head according to claim 1, wherein the liquid ejection portion includes a recording element substrate having a recording element configured to generate energy to eject a liquid.

17. The liquid ejection head according to claim 16, wherein the liquid ejection head is a page wide type liquid ejection head in which a plurality of the recording element substrates are arranged.

18. The liquid ejection head according to claim 16, wherein the recording element substrate includes a pressure chamber having the recording element therein, and a liquid in the pressure chamber is circulated between the pressure chamber and an outside of the pressure chamber.

* * * * *